US010144896B2

(12) United States Patent
Ekman et al.

(10) Patent No.: US 10,144,896 B2
(45) Date of Patent: Dec. 4, 2018

(54) COMPOSITION

(71) Applicant: AB NANOL TECHNOLOGIES OY, Helsinki (FI)

(72) Inventors: Kenneth Ekman, Vasa (FI); Anders Soedergaerd, Vasa (FI); Patrik Strand, Helsinki (FI); Johan Von Knorring, Helsinki (FI); Aubrey Burrows, Norfolk (GB); Sophia Von Haartman, Turku (FI)

(73) Assignee: AB NANOL TECHNOLOGIES OY, Helsinki (FI)

( * ) Notice: Subject to any disclaimer, the term of this patent is extended or adjusted under 35 U.S.C. 154(b) by 0 days.

(21) Appl. No.: 15/311,577

(22) PCT Filed: May 15, 2015

(86) PCT No.: PCT/EP2015/060811

§ 371 (c)(1),
(2) Date: Nov. 16, 2016

(87) PCT Pub. No.: WO2015/173421

PCT Pub. Date: Nov. 19, 2015

(65) Prior Publication Data

US 2017/0158980 A1 Jun. 8, 2017

(30) Foreign Application Priority Data

May 16, 2014 (WO) ..... PCT/EP2014/060122

(51) Int. Cl.

| | |
|---|---|
| ***C10M 103/04*** | (2006.01) |
| ***C10M 125/04*** | (2006.01) |
| ***C10M 141/12*** | (2006.01) |

(52) U.S. Cl.
CPC ..... *C10M 125/04* (2013.01); *C10M 141/12* (2013.01); *C10M 2201/06* (2013.01);
(Continued)

(58) Field of Classification Search
CPC ..... C10M 113/06; C10M 113/08; C10M 2201/05; C10M 103/04; C10M 103/06;
(Continued)

(56) References Cited

U.S. PATENT DOCUMENTS

| | | | |
|---|---|---|---|
| 2,737,496 | A | 3/1956 | Catlin |
| 3,249,545 | A | 5/1966 | van der Voort et al. |

(Continued)

FOREIGN PATENT DOCUMENTS

| | | | |
|---|---|---|---|
| CN | 102174341 | A | 9/2011 |
| EP | 440506 | A2 | 8/1991 |

(Continued)

OTHER PUBLICATIONS

International Preliminary Report on Patentability and Written Opinion for PCT/EP2015/060811 dated Nov. 22, 2016.

(Continued)

*Primary Examiner* — Ellen M McAvoy
(74) *Attorney, Agent, or Firm* — Marshall, Gerstein & Borun LLP

(57) ABSTRACT

The present invention describes a composition characterized in that the composition comprises a first metal component and particles including a second metal component. Furthermore the present invention describes a lubricant additive composition, a lubricant composition and a grease composition comprising the present composition.

19 Claims, 5 Drawing Sheets
(3 of 5 Drawing Sheet(s) Filed in Color)

(52) U.S. Cl.
CPC . *C10M 2207/126* (2013.01); *C10M 2215/064* (2013.01); *C10M 2215/086* (2013.01); *C10N 2210/01* (2013.01); *C10N 2220/082* (2013.01); *C10N 2230/06* (2013.01); *C10N 2230/54* (2013.01); *C10N 2250/10* (2013.01)

(58) Field of Classification Search
CPC C10M 125/04; C10M 125/08; C10M 125/10; C10M 125/12; C10M 2201/06; C10M 2201/08
See application file for complete search history.

(56) References Cited

U.S. PATENT DOCUMENTS 4,021,357 A 5/1977 Morduchowitz et al.
4,146,489 A 3/1979 Stambaugh et al.
4,292,414 A 9/1981 Saito et al.
4,431,553 A 2/1984 Fodor et al.
4,506,056 A 3/1985 Gaylord
4,552,677 A 11/1985 Hopkins
4,705,641 A 11/1987 Goldblatt et al.
4,867,890 A * 9/1989 Colclough ..... C10M 167/00 508/192
5,075,019 A * 12/1991 Evans ..... C08F 8/44 508/260
5,116,522 A 5/1992 Brown et al.
5,130,359 A 7/1992 Ohsumi et al.
5,141,996 A 8/1992 Zon et al.
5,171,461 A * 12/1992 Di Biase ..... C07G 17/002 508/259
5,397,485 A * 3/1995 Weichsel ..... C10M 125/04 508/150
5,520,830 A * 5/1996 Klaus ..... C10M 125/04 508/150
5,523,006 A * 6/1996 Strumban ..... C10M 103/04 420/457
5,558,805 A * 9/1996 Colclough ..... C10M 135/00 508/243
5,631,212 A * 5/1997 Vrahopoulou ..... C10M 141/06 508/192
5,731,273 A * 3/1998 Field ..... C10M 143/00 508/251
5,994,277 A * 11/1999 Ritchie ..... C10M 141/06 508/365
6,204,224 B1 3/2001 Quintero et al.
6,294,507 B1 * 9/2001 Dahl ..... C10M 129/36 508/459
6,331,510 B1 12/2001 Curtis et al.
6,372,696 B1 4/2002 Tipton
6,613,721 B1 9/2003 Kernizan et al.
6,746,993 B2 6/2004 Yuki et al.
7,244,696 B2 * 7/2007 Patel ..... C10M 169/00 508/150
8,048,526 B2 * 11/2011 Mizrahi ..... C10M 125/04 427/214
8,153,257 B2 * 4/2012 Mizrahi ..... C10M 161/00 427/214
8,282,852 B2 * 10/2012 Marur ..... H01F 1/36 252/62.51 R
8,445,415 B2 * 5/2013 Mabuchi ..... C10M 141/12 508/113
8,741,821 B2 * 6/2014 Jao ..... B82Y 30/00 423/263
9,169,377 B2 * 10/2015 Nanayakkara ..... C08L 21/00
2004/0087452 A1 * 5/2004 Noles ..... C10M 163/00 508/294
2005/0124504 A1 * 6/2005 Zhang ..... B82Y 30/00 508/128
2005/0245406 A1 11/2005 Scherer et al.
2006/0053972 A1 * 3/2006 Liu ..... B22F 1/0022 75/373
2007/0191238 A1 8/2007 Fischer et al.
2008/0161213 A1 * 7/2008 Jao ..... B82Y 30/00 508/165
2011/0257055 A1 * 10/2011 Baran ..... C10M 139/04 508/201
2011/0306527 A1 12/2011 Bouffet et al.
2012/0004153 A1 1/2012 Beret
2012/0055554 A1 3/2012 Radu et al.
2012/0101013 A1 4/2012 Mizrahi
2012/0149613 A1 6/2012 David et al.
2013/0228465 A1 * 9/2013 Zhang-Beglinger ..... C25D 3/02 205/50
2013/0315972 A1 * 11/2013 Krasnow ..... A01N 25/12 424/409
2014/0213491 A1 * 7/2014 Zhang ..... C10M 125/04 508/151
2015/0294753 A1 * 10/2015 Ramon Raygoza ... B82Y 30/00 252/572
2016/0172809 A1 * 6/2016 Holzapfel ..... H01R 39/025 439/13
2016/0177212 A1 * 6/2016 Wiley ..... C10M 171/06 427/367
2016/0298052 A1 * 10/2016 Gieselman ..... C10M 133/56
2017/0073612 A1 * 3/2017 Thiebaut ..... C10M 141/12

FOREIGN PATENT DOCUMENTS

EP 668342 A1 8/1995
EP 776959 A2 6/1997
EP 1493800 A1 1/2005
EP 1925657 A2 5/2008
EP 2140958 A2 1/2010
RU 2124556 C1 1/1999
RU 2277579 C1 6/2006
RU 2311447 C1 11/2007
RU 2338777 C1 11/2008
RU 2503713 C1 1/2014
WO WO-97/21788 A1 6/1997
WO WO-98/13443 A1 4/1998
WO WO-99/20720 A1 4/1999
WO WO-99/21902 A1 5/1999
WO WO-99/41332 A1 8/1999
WO WO-00/08115 A1 2/2000
WO WO-00/14179 A1 3/2000
WO WO-00/14183 A1 3/2000
WO WO-00/14187 A2 3/2000
WO WO-00/14188 A2 3/2000
WO WO-00/15736 A2 3/2000
WO WO-01/18156 A1 3/2001
WO WO-01/57166 A1 8/2001
WO WO-2004/087850 A1 10/2004
WO WO-2005/097956 A1 10/2005
WO WO-2006/0007934 A1 1/2006
WO WO-2006/105926 A1 10/2006
WO WO-2008/055976 A2 5/2008
WO WO-2011/020863 A1 2/2011
WO WO-2012/076025 A1 6/2012
WO WO-2012/107649 A1 8/2012

OTHER PUBLICATIONS

Gang Liu et al., "Enhancing AW/EP Property of Lubricant Oil by Adding Nano Al/Sn Particles", Tribology Letters, Kluwer Academic Publishers-Plenum Publishers, NE, vol. 18, No. 1, Jan. 1, 2005.
Bakunn V N et al., "Tribological Behavior and Tribofilm Composite in Lubricated Systems Containing Surface-Capped Molybdenum Sulfide Nanoparticles", Tribology Letters, Kluwer Academic Publishers-Plenum Publishers, NE, vol. 22, No. 3, Jul. 19, 2006.
Database WPI Week 200019 Thomson Scientific, London, GB; AN 2000-221950 XP002726380 relating to RU 2124556, Jan. 10, 1999, 2 pages.
Database WPI Week 201407 Thomson Scientific, London, GB; AN 2014-B04810 XP002726381 relating to RU 2503713, Nov. 27, 2012, 2 pages.
Search Report in International Application No. PCT/EP2015/060811 dated Dec. 18, 2015, pp. 6 pages.

(56) References Cited

OTHER PUBLICATIONS

Official Action in EP Application No. 15 722 229.0 dated Nov. 22, 2017, 5 pages.

* cited by examiner

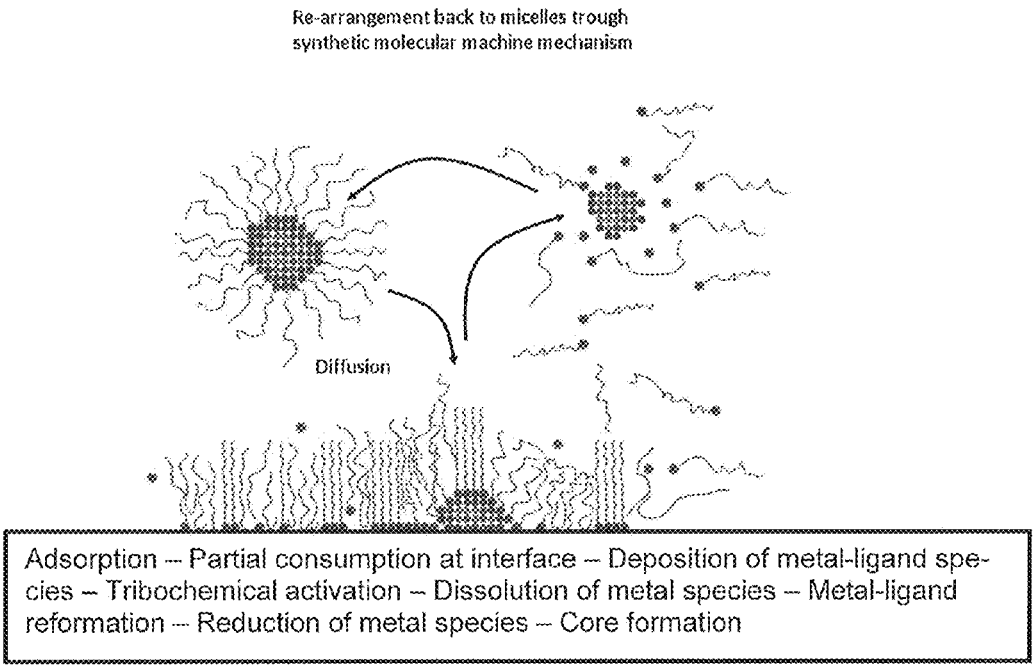
Figure 1
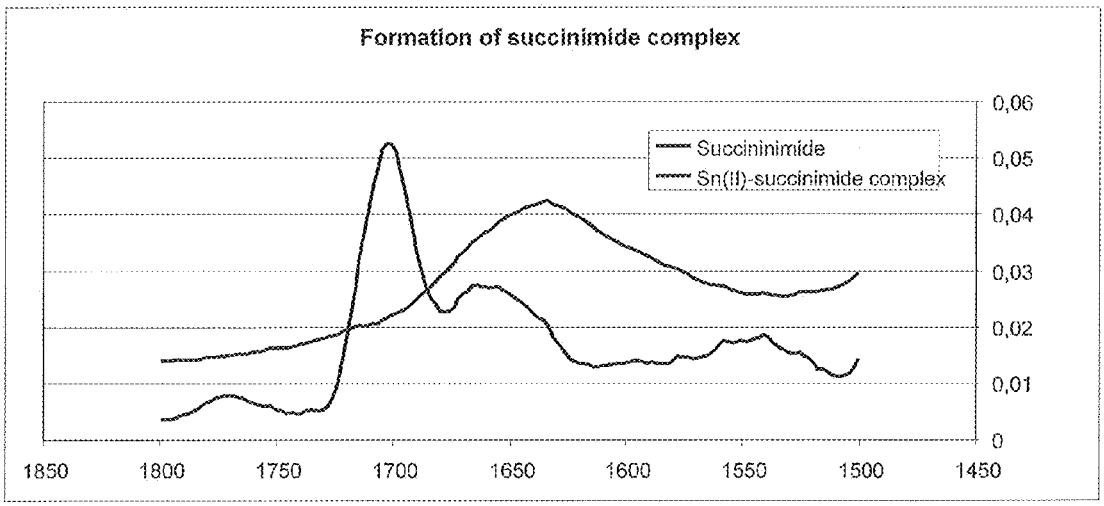
*Fig. 2.* *FTIR-spectra for succinimide and the tin-succinimide complex*

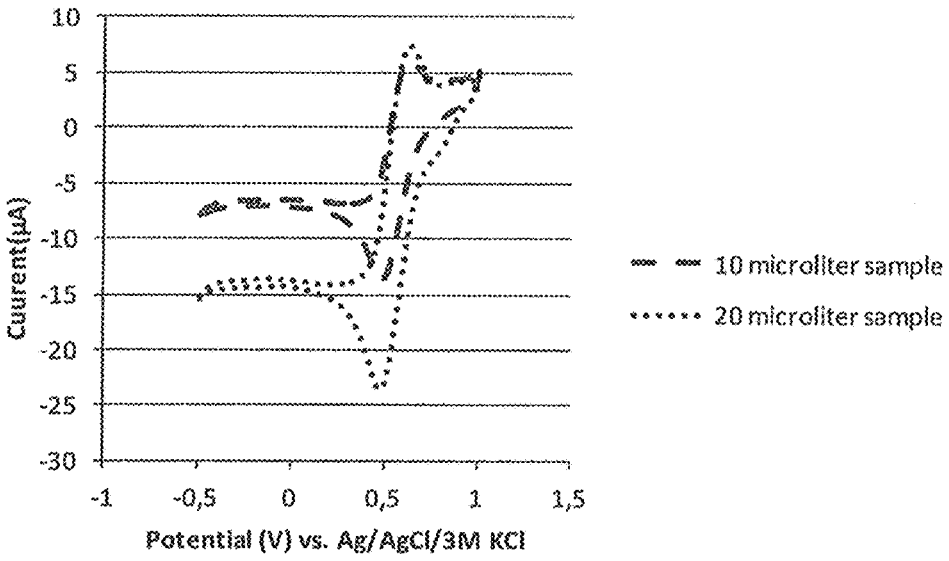
Fig. 3. Cyclic voltammograms for Cu in $CuCl_2$ in diethylene glycol
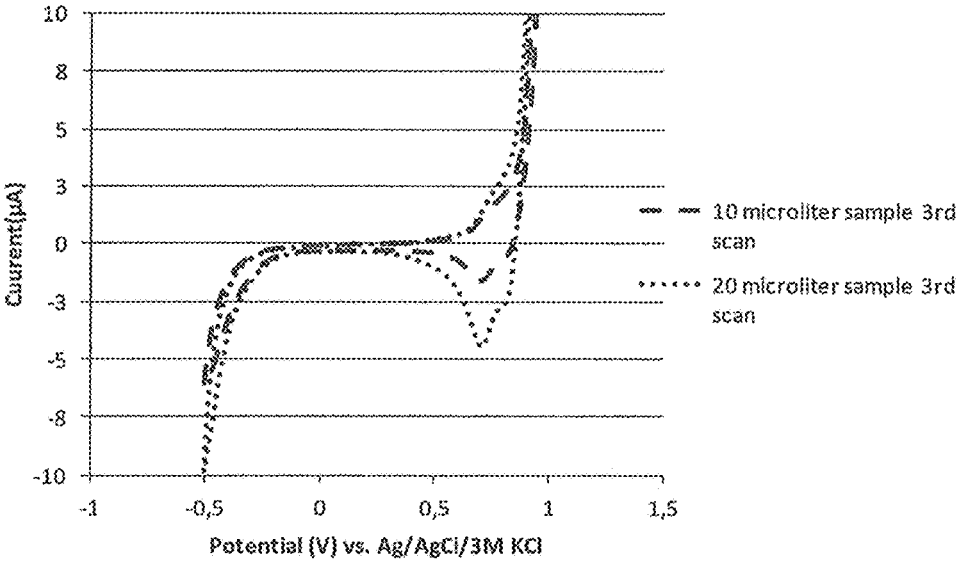
Fig. 4. Cyclic voltammograms for Cu in the activated complex

COMPOSITION

FIELD OF THE INVENTION

The present invention relates to a composition. Furthermore, the present invention relates to a method for producing the composition. Moreover, the present invention describes a lubricant additive composition, a lubricant composition and a grease composition comprising the composition, preferably the lubricant additive composition.

BACKGROUND OF THE INVENTION

Lubricating fluids are used in many technology fields like for instance in vehicles, energy producing equipment and metal working processes. Tribologically active additives have since many decades been developed in order to reduce the energy consumption and prolong the life-time of the lubricated surfaces. Most of the additives are organic or organometallic compounds with an ability to form protective tribological layers on the friction surfaces.

Lubricants in roller bearings and friction bearings ensure that a film of lubricant, which transfers loads and separates different parts, is established between parts that rub or slide against one another. This achieves the result that metallic surfaces do not come in contact with one another and therefore there is no wear. The lubricants must therefore meet high demands. These includes extreme operating conditions such as very high or very low rotational speeds, high temperatures caused by high rotational speeds or by long-distance heating, very low temperatures, e.g., in bearings that operate in a cold environment or which occur with use in aviation and space travel. Likewise, modern lubricants should be suitable for use under so-called clean room conditions in order to avoid soiling of the room due to abrasion and/or the consumption of lubricants. Furthermore, in use in modern lubricants, evaporation and thus "lackification," i.e. such that they become solidified after a short application and no longer manifests a lubricating effect, should be avoided. Especially high demands are also made of lubricants during use such that the running surfaces of the bearings are not attacked due to slight friction, so that the bearing surfaces run noiselessly and long running times without relubrication are promoted. Lubricants must also withstand the action of forces such as centrifugal force, gravitational force and vibrations.

The improvement of wear and friction resistance of moving parts in bearings and machines is highly desirable in the modern automotive and transportation industry, as a major part of machine breakdowns are caused by mechanical wear of their moving parts. Typically, friction between moving parts in a system is reduced with different kinds of lubricants separating the moving parts, as lubricant-to-surface friction is much less detrimental than surface-to-surface friction.

Current market trends require lubricant and grease compositions having improved efficiency regarding friction, durability and wear.

Metal salts have been used for affecting the wear properties like for instance in U.S. Pat. No. 4,705,641 of Nov. 10, 1987 where an oil additive is presented which provides improved oxidation stability and anti-wear properties. The additive is based on a copper salt and a molybdenum salt in amounts ranging between 0.002 and 0.3 weight percent and 0.006 and 0.5 weight percent, respectively. The metal salts are selected from carboxylates like for instance naphthenates, oleates and stearates in order to make the metal more compatible with the oil. Similar compositions are disclosed in U.S. Pat. No. 4,431,553 and U.S. Pat. No. 4,552,677.

The abstract of CN 102174341 of Sep. 7, 2011 describes a method for preparing a stable nano-sized copper-based lubrication oil additive prepared by starting from a copper chloride—sodium hydroxide solution, which was filtered and further reacted with formic acid after which the formed Cu-formate powder was dried and milled. Part of the Cu-formate was immobilized on carbon-nanotubes and mixed together with the Cu-formate powder into lubrication oil whereby a stable dispersion was obtained. Furthermore, US 2012/101013 A1 discloses a lubricant composition comprising nanoparticles having an inorganic core and a block copolymer component. The inorganic core may comprise oxides, such as calcium oxide, magnesium oxide and metals, such as metallic aluminum, metallic tin.

In U.S. Pat. No. 6,613,721 of Sep. 2, 2003 a lubricant additive is disclosed. The additive is based on a colloidal suspension of single metal particle cores surrounded by surfactants. The size of colloids are in the range of 0.5-4 μm and contains one of the metals selected from bismuth, zinc, copper, tin or silver. The surrounding surfactant is selected from sarcosinates, sulfonates or octadecenyl amine.

WO 2012/107649 of Aug. 12, 2012 describes an optimized lubricant additive composition based on oil soluble metal salts of inorganic and organic acids in combination with standard oil additives. According to the disclosed compositions a thin friction reducing metal film is formed on the sliding surfaces. A similar composition is disclosed in RU2277579 of Jun. 10, 2006 where a composition based on metal salts and a mixture of standard lubrication additive components like for instance succinimide, aromatic amines, epoxy resins and aliphatic alcohols have been used as wear reducing additive in lubricants. Similar compositions are disclosed in RU 2311447 and RU 2338777. However, the lubricating composition has been found to suffer from poor stability due to poor compatibility of the components used.

The Russian patent RU 2,124,556 describes metal-plating compositions comprising a metal powder based primarily on copper having a particle size in the micrometer range. Preferably, the particles are produced by way of evaporation and a subsequent condensation in inert gas. It is claimed that this combination of components overcomes the problem of agglomeration and sedimentation as well as providing effective metal plating performance to protect against wear and reduce friction between metal surfaces. Similar compositions are described in Russian patent RU 2,503,713 for use as a grease additive. However, these lubricating compositions have been found to suffer from poor stability due to agglomeration and sedimentation of particles. Furthermore, the compositions have a low performance, especially in friction and wear.

Although this prior art shows that useful additive compositions are available it also shows that there are shortcomings. It is a critical requirement to improve the properties of the additive compositions and the lubricant and grease compositions in order to produce a stable and effective performance additive system. These important improvements are achieved in the present invention.

PURPOSE OF THE INVENTION

The purpose of the present invention is to eliminate the drawbacks mentioned above. The purpose of the present invention is to prolong the lifespan of moving parts such as parts of bearings, machines and vehicles by reducing temperatures of friction surfaces and improving abrasive resistance, thus reducing wear of their moving parts. This is achieved by protecting friction surfaces with a novel lubricant composition comprising a composition of the present invention, preferably an additive composition.

An additional purpose is providing a composition having a high stability and a high durability. The composition should exhibit no agglomeration and no sedimentation.

A further purpose of the composition according to the present invention is to provide an environmentally friendly lubricant comprising significantly less toxic and environmentally harmful chemicals or components than the lubricants and lubricant additives currently available on the market. Furthermore, it was thus an object of the present invention to provide an additive composition that leads to a reduction in the fuel consumption. Furthermore, the additive composition should enable longer oil drain intervals and grease change intervals and improved operational lifetime.

A further objective of the present invention is development of a lubricant for application on the railway transport that can sustain high unit loads; provide long-lasting operation life of conjugated pairs protecting them from contact fatigue damages, decreasing the wear of the friction pairs wheel-rail and traction units of traction vehicles, providing protection of the friction surfaces from hydrogen wear and implementing the auto-compensation of wear and damages. Especially with regard to the railroad application, the present grease composition should enable a higher blocking efficiency regarding lubricant losses to the road-bed.

An additional technical task of the present invention is development of a lubricant that can provide long-lasting operation time of roller bearings of axle boxes with a low friction coefficient and eliminate overheating of roller bearings in long-term operation as well as reduce damages through hydrogen wear.

These improvements should be achieved without environmental drawbacks.

BRIEF DESCRIPTION OF THE DRAWINGS

The patent or application file contains at least one drawing executed in color. Copies of this patent or patent application publication with color drawings will be provided by the Office upon request and payment of the necessary fee.

FIG. 1 shows a schematic description of a theory regarding the synthetic molecular machine as mentioned above and below. It is believed that the following steps occur: Adsorption Partial consumption at interface—Deposition of metal-ligand species—Tribochemical activation—Dissolution of metal species—Metal-ligand reformation—Reduction of metal species—Core formation. These steps form a cycle rearranging the components back to micelles so that a synthetic molecular machine is formed. The energy input in this kind of molecular motor is in the form of tribochemical energy and heat and the response is in form of electrochemical reactions where the metal in its reduced form is participating in building up a temporary lubricating nanolayer. The phenomena related to the invention are believed to involve conformational changes that induce the reversible redox reactions in cyclic reaction sequences as a result of tribochemical initiation. The reversible reduction reactions are followed by a sequence of oxidation reactions due to the presence of oxidants and energy input in the form of shear forces.

FIG. 2 shows the change in the carbonyl peak for succinimide as a result of the complex formation by coordination. The coordination behavior was verified by FTIR and found to take place regardless oxidation state and could be noticed for both inorganic salts ($SnCl_2$, $SnCl_4$) but also for one organometallic salt tested (Sn(II)-2-ethylhexanoate). The total disappearance of the peaks related to the carbonyls indicates that tin is possibly coordinated to succinimide-groups in a bidentate manner.

FIGS. 3 and 4 demonstrate voltammograms showing that the reduction peak for copper has been shifted to higher potentials after the addition of the activating substances. The shifted reduction peak for copper in the activated complex verifies that the reducibility of copper is increasing as a result of the activation.

SUMMARY OF THE INVENTION

Figure 5:
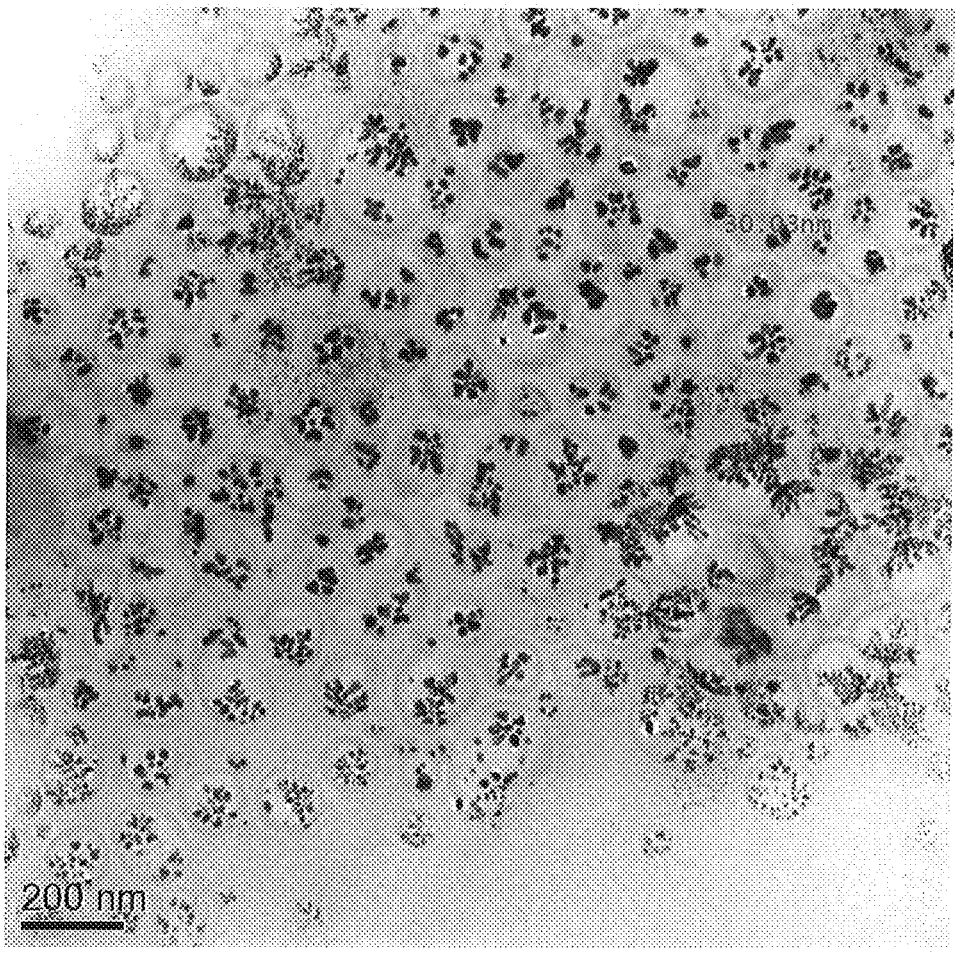
FIGS. 5 and 6 show micelles comprising a first metal component in metallic form, such as copper and a second metal component in salt form, such as Sn (II) and/or Sn(IV). The micelles are preferably stabilized by a ligand. Preferably, the particles, especially the nanoparticles include the second metal component and a ligand, especially a complex comprising the second metal element and a ligand.

The present invention provides a composition characterized in that the additive composition comprises a first metal component and particles including a second metal component. Preferably, the particles are nanoparticles.

Preferably, the second metal component is able to reduce an oxidized form of the metal element being comprised in the first metal component.

Preferably, the second metal component is able to influence the redox potential of the metal element being comprised in the first metal component.

Preferably, the second metal component is able to reduce an oxidized form of the metal element being comprised in the first metal component and the composition, preferably lubricant additive composition, comprises a compound including a ligand and the metal element being comprised in the second metal component.

Preferably, the composition, preferably lubricant additive composition, comprises particles, especially nanoparticles, including the first metal component and the second metal component.

Preferably, the composition, preferably lubricant additive composition, comprises a compound including a ligand and the metal element being comprised in the second metal component.

Preferably, the composition, preferably lubricant additive composition, comprises at least one compound improving the solubility of an oxidized form of the metal element being comprised in the first metal component.

Preferably, the composition, preferably lubricant additive composition, comprises at least one reducing agent.

Preferably, the difference of the standard electrode potentials of the metal element being comprised in the second metal component and the metal element being comprised in the first metal component is at least 0.2 V, based on the metallic form of each metal element and the first stable oxidized stage.

Preferably, the first metal component comprises gold, silver, copper, palladium, tin, cobalt, zinc, bismuth, manganese and/or molybdenum, especially preferably copper and/or cobalt, more preferably copper.

Preferably, the second metal component comprises tin, bismuth, zinc, and/or molybdenum, especially preferably, tin, bismuth and/or zinc, more preferably tin.

Preferably, the particles, preferably nanoparticles, include a second metal component comprising the first metal component in metallic form.

Preferably, the composition, preferably lubricant additive composition, comprises a soluble metal compound being derived from the first metal component.

Preferably, the composition, preferably lubricant additive composition, comprises a soluble metal compound being derived from a third metal component. The third metal component may have similar properties as disclosed with regard to the first metal component.

Preferably, the composition, preferably lubricant additive composition, is able to form metal plating.

Furthermore, the present invention provides a method for producing the composition comprising the steps of forming particles, preferably comprising the second metal component and mixing the particles, preferably nanoparticles, with the first metal component. Moreover, the present invention provides a composition, preferably lubricant additive composition, being obtainable by said method.

In addition thereto, the present invention provides a lubricant composition comprising a composition, preferably lubricant additive composition, in accordance with the definitions provided above and below. Moreover, the present invention provides a grease composition comprising a composition, preferably lubricant additive composition, in accordance with the definitions provided above and below.

Furthermore, the present invention provides a lubricant additive composition, a lubricant composition and a grease composition leading to a reduction in the fuel consumption. Preferably, the composition, preferably lubricant additive composition, according to the present invention does not comprise essential amounts of phosphorus-nor sulfur-based compounds.

Moreover, the lubricant additive composition enables longer oils drain intervals and grease change intervals and improved operational lifetime. In addition thereto, the present grease composition enables a higher blocking efficiency regarding lubricant losses to the road-bed.

DETAILED DESCRIPTION OF THE INVENTION

The invention is based on research work, the aim of which was to reduce wear and friction and improve other desired properties of lubricants and greases. Surprisingly, it was found that special compositions comprising the components as mentioned in present claim 1 are able to solve those problems. Without being bound to any theory, the inventors believe that influencing of the redox properties of a metal component being able to form a metal plating on a friction surface may reduce wear and friction and improve other desired properties of a composition, a lubricant additive composition, a lubricant composition and/or a grease composition.

The present invention is focused on a composition, preferably lubricant additive composition, comprising a first metal component. Without being bound to any theory, the inventors believe that the metal element of the first metal component is preferably able to form metal plating on the friction surface. Metal plating means that some amounts of the first metal component are deposited on friction surfaces. However, there is no need to form a closed coating on the surface. According to a preferred embodiment of the present invention, the ions preferably have higher ionization energy and/or have higher redox standard potentials than that of the surface metal ions; i.e. if a friction surface is made of steel, the composition, preferably lubricant additive composition, preferably comprise ions of metals having higher ionization energy and/or have higher redox standard potentials than Fe. In such context, the ionization energy refers to the stable ionization state of the surface metal ions and the ions used in the lubricant composition. The redox standard potentials refer to the values measured at 20° C. and pH 7.0 according to ASTM D1498-14 and/or DIN 38404-6. E.g. is the surface is made of steel, the additive composition may comprise copper ions. The metal ions are selected such that the metal ions present in the lubricant fulfill the vacancies and diffuse inside the frictional surface removing dislocations caused by friction and forming crystals of protective thin metal film on the surface. Ionization energy is an approximation in order to achieve a deposition of metal ions of the additive composition. The ions of Au, Ag, Pd, Cu, Co, Pb, Sn, Bi, Mo and Ni are useful for surfaces comprising iron such as steel.

However, according to a further embodiment of the present invention, the composition, preferably lubricant additive composition, the lubricant composition and the grease composition can be used to lubricate surfaces containing no metals such as surfaces made of diamond like carbon (DLC) well known in the art.

Preferably, the first metal component comprises Au, Ag, Pd, Cu, Co, Pb, Sn, Bi, Mo and Ni as metal element. Preferably, the first metal component comprises gold, silver, copper, palladium, tin, cobalt, zinc, bismuth and/or molybdenum, preferably copper and/or cobalt, more preferably copper.

The first metal component can be present in a solute form. That is, preferably at least a part of the first component is soluble in the solvent or dispersing medium of the composition, preferably additive composition of the present invention. Preferably, the first metal component may be blended into the oil as any suitable oil soluble metal compound, preferably copper compound. By oil soluble we mean the compound is oil soluble under normal blending conditions in the oil or additive package.

Preferably, the oil solubility refers to typical base oils as disclosed above and below to an extent sufficient to be used for the purpose intended. The oil might be for example a synthetic or mineral oil or mixtures thereof including liquid petroleum oils of the paraffinic, naphthenic or mixed paraffinic-naphthenic types in combination with inert hydrocarbon solvents such as for example aliphatic materials like heptane, hexane, pentane, isooctane, purified kerosene, cyclopentane and cyclohexane as well as aromatic materials like benzene, toluene, and xylene. Typically the preferred solvent system is a Group I base oil with an aromatics content of at least 15% and a saturates content not exceeding 85%. More preferably, the solubility refers to a mixture containing about 30% by weight of toluene and about 70% by weight of cyclohexane.

More preferably, the term soluble means that a compound has a solubility at 20° C. under normal pressure (1013.25 mbar) of at least 0.1 g per kg of the solution, especially preferably of at least 0.2 g per kg of the solution and even more preferably of at least 0.5 g per kg of the solution. The expression insoluble means solubility below these values.

Soluble metallic compounds are well known in the art. These metallic compounds include oil soluble metal salts of inorganic acids comprise, i.e. chlorides, bromides and/or iodides. Furthermore these metallic compounds include soluble metal salts of organic acids. Preferably, the organic acids comprise carbon atoms and oxygen atoms.

Preferably, the first metal component may comprise oil soluble metal salts of inorganic acid comprise oil soluble metal salts, i.e. chlorides, bromides and/or iodides of at least one of the following metals: Cu, Co, Pb, Sn, Bi, Mo, Ni. More preferably, the oil soluble metal salts of inorganic acid comprise CuCl, CuBr, CuI, $CuCl_2$, $CuBr_2$, $CoCl_2$, $CoBr_2$, $CoI_2$, $PbCl_2$, $PbBr_2$, $PbI_2$, $SnCl_2$, $SnBr_2$, $SnI_2$, $BiCl_3$, $MoCl_2$, $NiCl_2$, $NiBr_2$ and/or $NiI_2$. Copper salts are especially preferred.

Preferably, the first metal component may comprise an organic metal salt, more preferably a salt of a synthetic or natural carboxylic acid, especially preferably a copper salt of a synthetic or natural carboxylic acid. Examples include $C_{10}$ to $C_{18}$ fatty acids such as lauric, stearic or palmitic, but unsaturated acids such as linolenic, linoleic, arachidic, oleic or branched carboxylic acids such as tall oil acids and naphthenic acids of molecular weight from 200 to 500 or synthetic carboxylic acids are preferred because of the improved handling and solubility properties of the resulting metal carboxylates, preferably copper carboxylates.

Preferred metal salts of organic acids comprising organic acids having from 15 to 18 carbon atoms in their molecular formula, such as metal salts of oleic acid $CH_3(CH_2)_7CH{=}CH(CH_2)_7COOH$. Preferred examples of a metal salt of organic acids are tin oleate $C_{36}H_{66}O_4Sn$, copper oleate $C_{36}H_{66}O_4Cu$, nickel oleate $C_{36}H_{66}O_4Ni$, lead oleate $C_{36}H_{66}O_4Pb$ and cobalt oleate $C_{36}H_{66}O_4Co$ with copper oleate $C_{36}H_{66}O_4Cu$ being especially preferred.

The copper compound may be in the cuprous or cupric form. Exemplary of useful copper compounds are copper ($Cu^I$ and/or $Cu^{II}$) salts of alkenyl succinic acids or anhydrides. The salts themselves may be basic, neutral or acidic.

Examples of the metal salts of this invention are Cu salts of polyisobutenyl succinic anhydride (hereinafter referred to as Cu-PIBSA), and Cu salts of polyisobutenyl succinic acid. Preferably, the selected metal employed is its divalent form, e.g., $Cu^{2+}$. The preferred substrates are polyalkenyl succinic acids in which the alkenyl group has a number average molecular weight (Mn) greater than 700. The alkenyl group desirably has a Mn from 900 to 1400, and up to 2500, with a Mn of about 950 being most preferred. Especially preferred is polyisobutylene succinic acid (PIBSA). These materials may desirably be dissolved in a solvent, such as a mineral oil, and heated in the presence of a water solution (or slurry) of the metal bearing material. Heating may take place between 70° C. and 200° C. Temperatures of 110° C. to 140° C. are entirely adequate. It may be necessary, depending upon the salt produced, not to allow the reaction to remain at a temperature above about 140° C. for an extended period of time, e.g., longer than 5 hours, or decomposition of the salt may occur.

In another preferred embodiment of the present invention the composition comprises, in addition to the first metal component and particles, preferably nanoparticles, comprising the second metal component, at least one of the following: an aliphatic alcohol, a succinimide derivative, an aromatic amine, an epoxy resin and/or a 2-iminosubstituted indoline.

In another preferred embodiment of the present invention the succinimide derivative comprises S-5A polyalkenyl succinimide, the aromatic amine comprises homotype diphenylamine and the epoxy resin comprises commercially available aliphatic epoxy resin ДЭГ-1 (DEG-1), produced by condensation of epichlorohydrin with glycol.

The organic metal salts are preferred in comparison to the inorganic metal salts. Preferably, the weight ratio of organic metal salts to inorganic metal salts is more than 5, more preferably more than 10.

Preferably, said metal salts of the first metal component provide metal ions which fulfil the open vacancies and diffuse inside the frictional surface forming a thin metal film. This is a known practice in the art, with a composition disclosed in RU2277579, RU2311447, RU2338777 and WO 2012/076025 A1 being examples. The documents RU2277579, RU2311447, RU2338777 and WO 2012/076025 A1 are expressly incorporated herein by reference for their disclosure regarding metal salts. Furthermore, an additive comprising metal salts useful for the present invention is commercially available under the trademark VALENA®.

In a preferred embodiment of the present invention, the additive composition comprises particles, preferably nanoparticles, as disclosed above and below including the first metal component. These particles, preferably nanoparticles, may comprise the metallic form of Au, Ag, Pd, Cu, Co, Mo, Bi, Pb, Sn, Ni and/or insoluble metal salts of these metals. The term insoluble metal salts include the use of insoluble high amounts of soluble metal salts as mentioned above.

Preferably, the first metal component is a mixture of different compounds comprising one metal element. According to a special embodiment, the first metal component includes a soluble metal salt and the metallic form of the metal element being included in that soluble metal salt.

Especially preferred, the additive composition comprises the metallic element being present in the first metal component in a solute form and in particles, preferably nanoparticles, being dispersed in the additive composition. According to a special preferred embodiment of the present invention, the additive composition, the lubricant composition and/or the grease composition comprise as the first metal component a metal element in metallic form being contained in particles, preferably nanoparticles, and a soluble metal salt, preferably an organic soluble metal salt. Preferably, the additive composition may comprise a first metal component as particles, preferably nanoparticles, comprising metallic copper and a soluble organic copper salt. Preferably, the additive composition may comprise a first metal component as particles, preferably nanoparticles, comprising metallic cobalt and a soluble organic cobalt salt. Preferably, the additive composition may comprise a first metal component as particles, preferably nanoparticles, comprising metallic nickel and a soluble organic nickel salt. Regarding the first metal component, cobalt and copper are very preferred and copper is most preferred.

In addition to the first metal component, the composition of the present invention, preferably the lubricant additive composition comprises particles, preferably nanoparticles. Nanoparticles are well known in the art. Preferably, the diameter of the nanoparticles comprising the second metal component is in the range of 1 to 10 000 nm, preferably in the range of 5 to 1 000 nm, more preferably in the range of 10 to 500 nm, especially preferably in the range of 15 to 400 nm. More preferably, the diameter of the nanoparticles comprising the second metal component is in the range of 1 to 350 nm, more preferably 5 to 200 nm, especially preferably 10 to 100 nm and most preferably 15 to 90 nm. Preferably, the particle diameter as mentioned above refers to the number average as can be determined by optical methods such as microscopy, especially electron microscopy.

The particles are insoluble in the dispersing medium or solvent of the composition of the present invention.

According to a further preferred aspect of the present invention, the median diameter of the nanoparticles is generally in the range from 1 nm to 10 μm, preferably from 5 nm to 1 μm, more preferably from 10 nm to 500 nm, especially preferably in the range of 15 to 400 nm. More preferably, the median diameter of the nanoparticles is in the range of 1 to 350 nm, more preferably 5 to 200 nm, especially preferably 10 to 100 nm and most preferably 15 to 90 nm. The median particle size V50 is the number median, where the value for 50% by weight of particles is smaller than or identical with this value and that for 50% by weight of these particles is greater than or identical with this value.

According to a preferred aspect of the present invention, the particles, preferably nanoparticles are spherical. For the purposes of the present invention, the term spherical means that the particles preferably have a spherical shape, but it is clear to the person skilled in the art that, as a consequence of the methods of production, it is also possible that particles with some other shape may be present, or that the shape of the particles may deviate from the ideal spherical shape.

The term spherical therefore means that the ratio of the largest dimension of the particles to the smallest dimension is not more than 4, preferably not more than 2, each of these dimensions being measured through the centre of gravity of the particles. At least 70% of the particles are preferably spherical, particularly preferably at least 90%, based on the number of particles.

Preferably, the particles, preferably nanoparticles comprise one or more reducing metals and one or more oxidizing metals. The reducing—oxidizing metals preferably comprise elements selected from groups IB, II, III, VA, VIB, VIIB and VIIIB in the Table of Elements.

Preferably, at least one part of the particles, preferably nanoparticles includes the second metal component. The particles, preferably nanoparticles including the second metal element preferably have the size as mentioned above and below. In addition to the second metal component, the nanoparticle preferably includes the first metal component. That is, one nanoparticle preferably includes a mixture of the first metal component and the second metal component. According to a further embodiment, the composition, preferably lubricant additive composition may comprise a mixture of two different particles, preferably nanoparticles. One type of particles, preferably nanoparticles includes the first metal component, while the other type of particles, preferably nanoparticles includes the second metal component.

Preferably, the nanoparticle include at least one of element selected from the group consisting of gold, silver, copper, palladium, tin, cobalt, zinc, bismuth and/or molybdenum in metallic form and/or as a salt.

In a preferred embodiment, the nanoparticle include at least two of element selected from the group consisting of gold, silver, copper, palladium, tin, cobalt, zinc, bismuth, manganese and/or molybdenum in metallic form and/or as a salt. More preferably, the nanoparticle include at least one of element selected from the group consisting of gold, silver, copper and/or palladium, preferably copper in metallic form and at least one of element selected from the group consisting of tin, cobalt, zinc, bismuth, manganese and/or molybdenum, preferably tin as a salt. The element being in form of a salt can be preferably included in the nanoparticle as a complex. That is, most preferably, the nanoparticle includes copper in metallic form and a tin complex in the form of a salt.

Preferably, the second metal component is able to reduce an oxidized form of the metal element being comprised in the first metal component. More preferably, the difference of the standard electrode potentials of the metal element being comprised in the second metal component and the metal element being comprised in the first metal component is at least 0.1 V, especially preferably at least 0.2 V, based on the metallic form of each metal element and the first stable oxidized stage. The standard electrode potentials refer to the values measured at 20° C. and pH 7.0 according to ASTM D1498-14 and/or DIN 38404-6.

According to a preferred embodiment of the present invention, the second metal component is able to influence the redox potential of the metal element being comprised in the first metal component. Preferably, the metal element of second metal component is able to shift the $E_{redox}$ of the metal element of the first metal about at least 0.01 V, more preferably at least 0.02 V and most preferable at least 0.05 V based on the $E_{redox}$ value as measure by Cyclic voltammetry as mentioned in the Examples. Preferably, the redox potential of the metal element being comprised in the first metal component is shifted to higher potentials. That is, the oxidizing strength of the first metal component is enhanced.

Preferably, the second metal component comprises tin, bismuth, molybdenum, manganese and/or zinc, preferably tin, bismuth, molybdenum and/or zinc as metal element or metal ion. As mentioned above, the composition, preferably lubricant additive composition comprises particles, preferably nanoparticles including the second metal component. Preferably, at least a part of the second metal component is insoluble in the dispersing medium of said composition.

The insoluble part can be added to the composition, preferably lubricant additive composition, as particles, preferably nanoparticles. Furthermore, the particles, preferably nanoparticles can be obtained by precipitation of soluble compounds as mentioned in prior art such as U.S. Pat. No. 6,613,721.

Furthermore, the second metal component can be present in a solute form. That is, preferably at least a part of the second metal component is soluble in the solvent or dispersing medium of the additive composition.

Soluble metallic compounds useful as the second metal component are well known in the art. These metallic compounds include oil soluble metal salts of inorganic acids comprise, i.e. chlorides, bromides and/or iodides. Furthermore these metallic compounds include soluble metal salts of organic acids. Preferably, the organic acids comprise carbon atoms and oxygen atoms.

Preferably, the second metal component may comprise oil soluble metal salts of inorganic acid comprise oil soluble metal salts, i.e. chlorides, bromides and/or iodides of at least one of the following metals: Sn, Zn, Mo, Mn, and Bi. More preferably, the oil soluble metal salts of inorganic acid comprise $SnCl_2$, $SnBr_2$, $SnI_2$, $SnCl_4$, $SnBr_4$, $ZnCl_2$, $ZnBr_2$, $ZnI_2$, $MoCl_2$, $MoBr_2$, BiCl, BiBr, BiI, BiOCl, BiOBr and/or BiOI. Tin salts are especially preferred.

Preferably, the second metal component may comprise organic metal salt; preferably tin salt of a synthetic or natural carboxylic acid. Examples include $C_{10}$ to $C_{18}$ fatty acids such as lauric, stearic or palmitic, but unsaturated acids such as linolenic, linoleic, arachidic, oleic or branched carboxylic acids such as tall oil acids and naphthenic acids of molecular weight from 200 to 500 or synthetic carboxylic acids are preferred because of the improved handling and solubility properties of the resulting metal carboxylates, preferably tin carboxylates.

Preferred metal salts of organic acids comprising organic acids having from 15 to 18 carbon atoms in their molecular formula, such as metal salts of oleic acid $CH_3(CH_2)_7CH{=}CH(CH_2)_7COOH$ and 2-ethylhexanoic acid. Preferred examples of a metal salt of organic acids are tin oleate $C_{36}H_{66}O_4Sn$, tin 2-ethylhexanoate, molybdenum oleate, zinc oleate $C_{36}H_{66}O_4Zn$, zinc 2-ethylhexanoate, molybdenum 2-ethylhexanoate and bismuth oleate $C_{18}H_{33}O_2Bi$, with tin oleate $C_{36}H_{66}O_4Sn$ and tin 2-ethylhexanoate being especially preferred.

According to a preferred embodiment of the composition, preferably lubricant additive composition, the weight ratio of the first metal component to the second metal component is in the range of 10000:1 to 1:1000, more preferably 1000:1 to 1:100, especially preferably 20:1 to 1:2, particularly preferably 2:1 to 1:1. More preferably, the weight ratio of the first metal component to the second metal component is in the range of 10000:1 to 1:1, more preferably 1000:1 to 2:1, especially preferably 500:1 to 5:1, particularly preferably 100:1 to 10:1. This value considers the whole content of both components including the soluble parts and the parts being comprised in the particles, preferably nanoparticles.

Based on the weight of the metal elements, the weight ratio of the first metal element included in the first metal component to the second metal element included in the second metal component is in the range of 10000:1 to 1:1000, more preferably 1000:1 to 1:100, especially preferably 20:1 to 1:2, particularly preferably 2:1 to 1:1. More preferably, the weight ratio of the first metal element included in the first metal component to the second metal element included in the second metal component is in the range of 10000:1 to 1:1, more preferably 1000:1 to 2:1, especially preferably 500:1 to 5:1, particularly preferably 100:1 to 10:1.

According to a further embodiment of the present invention, the weight ratios of the soluble metal components (first and second metal components) to the particles, preferably nanoparticles is preferably in the range of 10000:1 to 1:1000, more preferably 1000:1 to 1:100, especially preferably 20:1 to 1:2, particularly preferably 2:1 to 1:1. More preferably, the weight ratio of the soluble metal components (first, second, third and further metal components) to the particles, preferably nanoparticles is in the range of 10000:1 to 1:1, more preferably 1000:1 to 2:1, especially preferably 500:1 to 5:1, particularly preferably 100:1 to 10:1.

In a preferred embodiment, the weight ratio of the soluble part of the first metal element included in the first metal component to the insoluble part of the first metal element included in the particles, preferably nanoparticles is in the range of 10000:1 to 1:1, more preferably 1000:1 to 2:1, especially preferably 500:1 to 5:1, particularly preferably 100:1 to 10:1, based on the weight of the metal element.

The weight ratios as mentioned above and below can be derived from the amount of compounds being used to achieve the composition of the present invention.

According to a preferred embodiment, the composition may include a third metal component, preferably being derived from the first and/or second metal component as being disclosed above. That is, preferably, the composition comprises three metal components wherein one of these metal components is soluble and at least one of these metal components is included in particles, preferably nanoparticles.

Preferably, the composition comprises a soluble third metal component and particles, preferably nanoparticles including a first and a second metal component as mentioned above.

The third metal component is preferably a soluble metal salt derived from copper, tin, cobalt, zinc, bismuth, manganese and/or molybdenum, preferably copper and/or cobalt, more preferably copper as mentioned above. Preferably, the soluble metal salt of the third metal component is an organic metal salt, more preferably a salt of a synthetic or natural carboxylic acid, e.g. copper, tin, cobalt, zinc, bismuth, manganese and/or molybdenum oleate, more preferably cobalt, zinc, bismuth, manganese oleate and especially preferably cobalt oleate.

According to a preferred embodiment of the composition, preferably lubricant additive composition, the weight ratio of the third metal component to the second metal component is in the range of 10000:1 to 1:1000, more preferably 1000:1 to 1:100, especially preferably 20:1 to 1:2, particularly preferably 2:1 to 1:1. More preferably, the weight ratio of the third metal component to the second metal component is in the range of 10000:1 to 1:1, more preferably 1000:1 to 2:1, especially preferably 500:1 to 5:1, particularly preferably 100:1 to 10:1. This value considers the whole content of both components including the soluble parts and the parts being comprised in the particles, preferably nanoparticles.

Based on the weight of the metal elements, the weight ratio of the third metal element included in the third metal component to the second metal element included in the second metal component is in the range of 10000:1 to 1:1000, more preferably 1000:1 to 1:100, especially preferably 20:1 to 1:2, particularly preferably 2:1 to 1:1. More preferably, the weight ratio of the third metal element included in the third metal component to the second metal element included in the second metal component is in the range of 10000:1 to 1:1, more preferably 1000:1 to 2:1, especially preferably 500:1 to 5:1, particularly preferably 100:1 to 10:1.

In a preferred embodiment, the weight ratio of the soluble part of the third metal element included in the third metal component to the insoluble part of the first metal element included in the particles, preferably nanoparticles is in the range of 10000:1 to 1:1, more preferably 1000:1 to 2:1, especially preferably 500:1 to 5:1, particularly preferably 100:1 to 10:1, based on the weight of the metal element.

The third metal component differs from the first and second metal components. Surprisingly, it has been found that the particles, preferably nanoparticles obtainable by the process of the present invention, preferably comprising the second metal component and more preferably comprising a ligand and/or other components as mentioned above and below is able to improve the activity of soluble metal compounds regarding wear and/or friction.

Preferably, the particles, preferably nanoparticles including the second metal component are achieved by a precipitation method starting from a soluble metal compound including the metal element of the second metal component and a soluble compound including the metal element of the first metal component. The obtained mixture is reacted in order to achieve particles, preferably nanoparticles. Preferably, the particles, preferably nanoparticles including a second metal component comprise the first metal component in metallic form.

Regarding the method for producing the particles of the present invention, the expression "soluble metal compound" refers to the solubility of a metal compound in a solvent being used to achieve the particles. These solvents may include base oils as mentioned above and below as well as hydrocarbons, especially aromatic hydrocarbons, such as toluene, esters, ketones and/or alcohols.

Regarding the composition of the present invention, the expression "soluble metal compound" refers to the solubility of a metal compound in a solvent or dispersing medium forming the continuous phase of the composition of the present invention. The particles are insoluble in the continuous phase of the composition of the present invention. Constituents of the particles are insoluble in the sense that these parts are not solved in the continuous phase. Preferably, the particles are micelles and, hence, the constituents of the micelles are considered as insoluble parts of the composition of the present invention, although the solubility of the component of the micelle itself might have a higher solubility level as mentioned above and below.

According to a further embodiment of the present invention, the composition, preferably lubricant additive composition, the lubricant composition and/or the grease includes an organometallic compound. Preferably, the organometallic compound comprises carboxylates, salicylates and sarcosinates of silver, copper, zinc, cobalt, molybdenum, iron, bismuth or nickel.

Preferably, the composition, preferably lubricant additive composition, comprises a compound including a ligand and the metal element being comprised in the second metal component. Astonishingly, improved results are achieved if the second metal component comprises a ligand. The complex including a ligand and the metal element of the second metal component can be obtained before the second metal component is reacted with the first metal component. Preferably, the ligand is a nitrogen-containing compound. Preferably, the ligand is a polydentate ligand having at least two binding sites, preferably at least three binding sites. The inventors believe that activation can be achieved by reaction of a soluble second metal compound with a ligand. Preferred ligands are molecules containing for instance carbonyl, carboxyl, carbonate, ester, amine, amide, imide, and/or hydroxyl functional groups, with cyclic imides being preferred, such as succinimide compounds.

Preferred compounds include succinimides, succinate esters, and mannich bases. It also includes functionalized polymers with amines grafted onto the polymer backbone to produce dispersant viscosity modifiers. Other chemistries can include oxazolines and derivatives of tris-(hydroxymethyl)amino methane (THAM). The key functional head groups include amines, amides, imides, esters, hydroxyamines and aminoesters. Preferred dispersant viscosity modifiers are described above and below. Especially preferred dispersants are described in Lubricant Additives: Chemistry and Applications, Second Edition, edited by Leslie R. Rudnick, CRC Press, 2009 which document is included by reference for the purpose of disclosure.

Non-excluding examples of organic ligands are carboxylic acids like for instance capric acid, myristic acid, caprylic acid and/or ethylhexanoic acid and imide compounds like for instance succinimide compounds as disclosed above and below.

Preferably, the composition, preferably lubricant additive composition, comprises at least one compound improving the solubility of an oxidized form of the metal element being comprised in the first metal component. Such compound can be selected from complexing agents and the above-mentioned anions of organic and/or inorganic acids.

According to a preferred aspect of the present invention, the composition, preferably lubricant additive composition, the lubricant composition and/or the grease comprise ligands enabling and/or catalyzing reversible redox reactions.

Preferably, the composition, preferably lubricant additive composition, comprises at least one reducing agent and/or assisting reductant. These reducing agents and/or assisting reductants include amines, alcohols, phenolic compounds and other compounds well known in the art. Preferred reducing agents include diphenylamine, alkylated diphenylamines, diamino phenols, alcohols, esters, ketones, naphthylamine derivatives, quinoline derivatives, amino derivatives of alkylated phenols, and aniline derivatives. Preferably diphenyl amine, diethylene glycol and/or octanol are used as reducing agent and/or assisting reductant, with diphenyl amine being especially preferred.

Preferably, the composition, preferably lubricant additive composition, according to the present invention forms a protective layer at the friction surfaces through physical bonding between the metal ions of the salt and the friction surfaces when added to friction surfaces. The composition, preferably lubricant additive composition, is preferably able to form metal plating. More preferably, the metal compound is just deposited on friction parts of the surface and does not form a closed layer.

The composition, preferably lubricant additive composition, preferably includes at least one solvent. These solvents are well known in the art and include hydrocarbons, especially aromatic hydrocarbons, such as toluene, esters, ketones, alcohols and base oils as mentioned above and below. Preferred alcohols include diethylene glycol and octanol.

Table 1 shows preferred compositions for lubricant additives according to the present invention.

TABLE 1

| | Amount in wt. % preferred | Amount in wt. % more preferred |
|---|---|---|
| solvent | 0 to 98.0 | 0.1 to 90.0 |
| first metal component | 0.25 to 99.0 | 0.5 to 98.0 |
| second metal component | 0.25 to 50.0 | 0.5 to 25.0 |
| ligand | 0 to 40.0 | 0.25 to 25.0 |
| reductant and/or reducing auxiliary | 0 to 40.0 | 0.25 to 25.0 |
| solvent | 0 to 50.0 | 0.1 to 40.0 |
| first metal component | 10 to 98.0 | 40 to 98.0 |
| second metal component | 0.01 to 20.0 | 0.05 to 10.0 |
| ligand | 0.01 to 20.0 | 0.05 to 10.0 |
| reductant and/or reducing auxiliary | 0.01 to 30.0 | 0.05 to 25.0 |

If the present composition comprises a third metal compound, the amounts of the third metal compound are included in the first metal component.

Table 1a shows preferred compositions for lubricant additives according to the pre-sent invention comprising a third metal component.

| | Amount in wt. % even more preferred | Amount in wt. % most preferred |
|---|---|---|
| solvent | 0 to 50.0 | 0.1 to 40.0 |
| first metal component | 0.001 to 2.0 | 0.005 to 1.0 |
| second metal component | 0.01 to 20.0 | 0.05 to 10.0 |
| Third metal component | 0.1 to 98.0 | 40 to 98.0 |
| ligand | 0.01 to 20.0 | 0.05 to 10.0 |
| reductant and/or reducing auxiliary | 0.01 to 30.0 | 0.05 to 25.0 |

Preferably, the composition, preferably lubricant additive composition, comprises about 0.5 to 30% by weight of particles, preferably nanoparticles comprising the second metal component, more preferably 1 to 20% by weight and especially preferably 2 to 10% by weight. More preferably, the composition, preferably lubricant additive composition, comprises about 0.01 to 15% by weight of particles, preferably nanoparticles comprising the second metal component, more preferably 0.1 to 10% by weight and especially preferably 0.5 to 5% by weight.

The solvent may have properties of a ligand, a reductant and/or a reducing auxiliary. In these cases, the upper limit of the solvent is assessed by the lower limits of residual components.

Without being bound to any theory, some aspects of the following suggestions may be useful in order to perform the present invention over the whole range claimed.

Substances that have the ability to reduce other substances, i.e. cause them to gain electrons, are said to be reductive or reducing and are known as reducing agents, reductants, or reducers. The reductant transfers electrons to another substance, and is thus itself oxidized. And, because a reductant donates electrons, the reducing agent is also called an electron donor. Electron donors can also form charge transfer complexes with electron acceptors.

The activation reaction is believed to start by the coordination of a metal containing oxidant to a functional group in an organic or organometallic ligand (I) whereby the activated complex is formed (II). In the presence of a reductant the activated complex will enable a fast reduction of the reductant in a synergistic way into a nano-precursor (III). The formed nano-precursor can in its simplest form be a nano-complex of one metal and one ligand, but the nano-precursor can also comprise several ligands or macromers and multinuclear complexes of same or different metals. The nano-precursor is eventually activated through conformational changes and chelating reorganizations and is through that able to further participate in redox reactions with other surrounding ions.

Without being bound to any theory, the process can in a simplified way be described in terms of a synthetic molecular machine, which is defined by being composed of a number of atoms and which produces electrochemical changes as a response to an input, generally in terms of energy. The energy input in this kind of molecular motor is in the form of tribochemical energy and heat and the response is in form of electrochemical reactions where the metal in its reduced form is participating in building up a temporary lubricating nanolayer. The phenomena related to the invention are believed to involve conformational changes that induce the reversible redox reactions in cyclic reaction sequences as a result of tribochemical initiation. The reversible reduction reactions are followed by a sequence of oxidation reactions due to the presence of oxidants and energy input in the form of shear forces, like schematically envisioned in FIG. 1.

The disclosed Tribochemical Synthetic Molecular Machine technology compositions in the present invention are complex mixtures but each component has a specific function that enables the combined system to operate as an effective lubricant and grease additive.

The role of the soluble metal compound being preferably included in the present composition, more preferably a metal salt of an organic acid, e.g. copper oleate (and alternatively other metal oleates) is to provide a source of metal ions that are reduced by the activated complex to form particles, preferably nanoparticles that deposit a tribofilm on metal friction surfaces in order to reduce friction and wear. The inventors believe that a metal salt of an organic acid, preferably copper oleate (and alternatively other metal oleates) also provides an oil soluble source of metal ions that play a key part in the formation of the reverse micelles. In addition, the metal ions also undergo redox reactions at the metal surface to reinforce and sustain the tribofilm.

The key of the present invention is the combination of two metal compounds interacting with each other. Preferably, these two metal compounds are able to form an activated complex. E.g. copper (II) chloride and other metal compounds as mentioned above and below can be used to form the activated complex along with the tin chloride (Sn(II) and/or Sn (IV)) and other metal compounds as mentioned above and below. The inventors believe that such combination of chemicals produces a redox system and is preferably assisted by the diphenylamine that acts as a reducing agent. The inventors believe that this combination of compounds reduces the first metal compound, e.g. copper (II) ions to copper (0) and form particles, preferably nanoparticles in-situ.

According to a preferred embodiment, the particles, preferably nanoparticles are micelles comprising a first metal component in metallic form, such as copper and a second metal component in salt form, such as Sn (II) and/or Sn(IV). The micelles are preferably stabilized by a ligand. Preferably, the particles, especially the nanoparticles include the second metal component and a ligand, especially a complex comprising the second metal element and a ligand. These micelles are shown, e.g. in FIGS. 5 and 6.

Surprising improvements can be achieved by using a ligand in order to stabilize the complex and enhance the formation of particles, preferably nanoparticles. Preferably, a N-containing compound, especially preferably succinimide and other compounds as mentioned above and below can be used to stabilize the reverse micelles.

Surprising improvements can be achieved by using an alcohol as reductant, solvent and/or cosolvent in the process to make the activated complex. More preferably, an alcohol comprising ether groups, such as glycols that might be alkylated with alkyl groups having 1 to 20 carbon atoms, e.g. diethylene glycol can be used, especially together with an alcohol having 1 to 20 carbon atoms, preferably 4 to 12 carbon atoms, such as octanol. They ensure that the additive system is homogenous and stable.

The epoxy resin is known to be a useful constituent in lubricant additives and coatings and acts as a tackifier. Surprisingly, it is also used as an effective agent in the present invention to help disperse particles.

Extensive field tests have been carried out with a copper based lubricant additive utilizing technology in the present invention. These marine diesel engines tests in ships have demonstrated the significant increased fuel efficiency that can be achieved and is proven by lower fuel consumption results (up to 7%). This is a consequence of reduced friction in the engine due to use of the lubricant additive. This reduced friction effect has also been demonstrated in rig and engine tests conducted under laboratory conditions.

Wear tests have also been conducted using a tribometer. The experiments were performed with modified test conditions to produce wear rates more representative of those found in real field systems. Continuous wear measurements were carried out using the radionuclide technique (RNT). The advantages of RNT technique are its accuracy as well as its ability to measure wear rates under transient conditions, not only just at the end of test.

The final steps in the reaction cycle may comprise a reduction reaction and formation of cores which act as species for micelles growing in two- or three-dimensional directions before adsorption and partial consumption at the sliding surfaces through tribochemical activation, which may involve oxidation. The inventors believe that micelles are thereafter reformed by the synthetic molecular machine mechanism as described above.

The inventors believe that the present additive composition provides a system imparting self-healing properties to surfaces being lubricated.

A further subject matter of the present invention is a lubricant additive composition comprising a composition according to the present invention as disclosed above and below. The composition according to the present invention and/or the lubricant additive composition may comprise conventional additives as disclosed above and below. Therefore, the present invention provides a mixture comprising a lubricant additive composition and a conventional additive package.

A further subject matter of the present invention is a lubricant composition comprising a composition, preferably lubricant additive composition according to the present invention as disclosed above and below.

The amount of composition, preferably lubricant additive composition, comprised in the lubricant composition may vary over a broad range. Furthermore, it is obvious to a person skilled in the art that a lubricant composition according to the present invention can be obtained by in situ forming the components of the composition, preferably lubricant additive composition. Therefore, a further subject matter of the present invention is a lubricant composition comprising a first metal component and particles, preferably nanoparticles including a second metal component.

Preferably, the lubricant composition comprises 0.05 to 20% by weight of a composition, preferably lubricant additive composition, more preferably 0.1 to 10% by weight and especially preferably 0.3 to 5%. More preferably, the lubricant composition comprises 0.05 to 15% by weight a composition, preferably lubricant additive composition, more preferably 0.1 to 8% by weight and especially preferably 0.2 to 3%. More preferably, the lubricant composition comprises 0.0001 to 15% by weight particles, preferably nanoparticles comprising the second metal component, more preferably 0.0005 to 8% by weight and especially preferably 0.001 to 3%. More preferably, the lubricant composition comprises 0.005 to 15% by weight of the first metal component, more preferably 0.01 to 8% by weight and especially preferably 0.03 to 3%. More preferably, the lubricant composition comprises 0.00005 to 15% by weight of the first metal component, more preferably 0.0001 to 8% by weight and especially preferably 0.0005 to 3%.

Preferably, the lubricant composition comprises about 0.005 to 10% by weight of particles, preferably nanoparticles comprising the second metal component, more preferably 0.01 to 5% by weight and especially preferably 0.1 to 3% by weight. More preferably, the lubricant composition comprises 0.0001 to 15% by weight particles, preferably nanoparticles being obtainable by the method of the present invention, more preferably 0.0005 to 8% by weight and especially preferably 0.001 to 3%.

Conventionally, a lubricant composition comprises base oil. Base oils that are useful in the practice of the present invention may be selected from natural oils, synthetic oils and mixtures thereof.

Natural oils include animal oils and vegetable oils (e.g., castor oil, lard oil); liquid petroleum oils and hydro-refined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Preferred base oils include those obtained by producing heavy linear chain paraffins in the Fischer-Tropsch process where hydrogen and carbon monoxide obtained by the gasification process (partial oxidation) of natural gas (methane etc.) are used and then subjecting this material to a catalytic cracking and isomerisation process.

Such Fischer-Tropsch derived base oils may conveniently be any Fischer-Tropsch derived base oil as disclosed in for example EP-A-776959, EP-A-668342, WO A 97/21788, WO-A-00/15736, WO-A-00/14188, WO-A-00/14187, WO-A-00/14183, WO-A-00/14179, WO-A-00/08115, WO-A-99/41332, EP-A-1029029, WO A 01/18156 and WO-A-01/57166.

Alkylene oxide polymers and interpolymers and derivatives thereof where the terminal hydroxyl groups have been modified by esterification, etherification, etc., constitute another class of known synthetic oils. These are exemplified by polyoxyalkylene polymers prepared by polymerization of ethylene oxide or propylene oxide, and the alkyl and aryl ethers of polyoxyalkylene polymers (e.g., methyl-polyisopropylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Examples of such esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes.

The oil of lubricating viscosity useful in the practice of the present invention may comprise one or more of a Group I Group II, Group III, Group IV or Group V oil or blends of the aforementioned oils. Definitions for the oils as used herein are the same as those found in the American Petroleum Institute (API) publication "Engine Oil Licensing and Certification System", Industry Services Department, Fourteenth Edition, December 1996, Addendum 1, December 1998. Said publication categorizes oils as follows:

a) Group I oils contain less than 90 percent saturates and/or greater than 0.03 percent sulfur and have a viscosity index greater than or equal to 80 and less than 120 using the test methods specified in Table 2.

b) Group II oils contain greater than or equal to 90 percent saturates and less than or equal to 0.03 percent sulfur and have a viscosity index greater than or equal to 80 and less than 120 using the test methods specified in Table 2. Although not a separate Group recognized by the API, Group II oils having a viscosity index greater than about 110 are often referred to as "Group II+" oils.

c) Group III oils contain greater than or equal to 90 percent saturates and less than or equal to 0.03 percent sulfur and have a viscosity index greater than or equal to 120 using the test methods specified in Table 2.

d) Group IV oils are polyalphaolefins (PAO).

e) Group V oils are all other base stocks not included in Group I, II, III, or IV.

TABLE 2

| Property | Test Method |
|---|---|
| Saturates | ASTM D2007 |
| Viscosity Index | ASTM D2270 |
| Sulfur | ASTM D4294 |

Preferably the volatility of the base oil, as measured by the Noack test (ASTM D5880), is less than or equal to about 40%, such as less than or equal to about 35%, preferably less than or equal to about 32%, such as less than or equal to about 28%, more preferably less than or equal to about 16%. Preferably, the viscosity index (VI) of the base oil is at least 100, preferably at least 110, more preferably greater than 120.

Base oils, also referred to as oils of lubricating viscosity useful in the context of the present invention may range in viscosity from light distillate mineral oils to heavy lubricating oils such as gasoline engine oils, mineral lubricating oils and heavy duty diesel oils. Generally, the viscosity of the oil ranges from about 2 $mm^2s^{-1}$ (centistokes) to about 200 $mm^2s^{-1}$, especially from about 4 $mm^2s^{-1}$ to about 40 $mm^2s^{-1}$ as measured at 100° C. (ASTM 445).

When applications such as lubricated bearings or centralized greasing for automobiles are targeted, a base oil or a base oil mixture will be preferred, for which the kinematic viscosity at 40° C. according to ASTM D445 is comprised between 10 and 80 $mm^2s^{-1}$ (centistokes), preferentially between 10 and 50 $mm^2s^{-1}$ (centistokes), preferentially between 20 and 40 $mm^2s^{-1}$ (centistokes), so as to guarantee good operability, good pumpability, and good cold properties, allowing use down to −20° C., or even down to −40° C. When applications such as transmissions are targeted, a base oil or a base oil mixture will be preferred, the kinematic viscosity of which at 40° C. according to ASTM D445 is comprised between 70 and 110 $mm^2s^{-1}$ (centistokes), preferentially between 30 and 40 $mm^2s^{-1}$ (centistokes), preferentially between 35 and 37 $mm^2s^{-1}$ (centistokes), so as to guarantee an adequate oil film under higher loads.

Preferably, the lubricant composition of the present invention comprises at least one viscosity index improver. Preferred viscosity index improvers for lubricant compositions advantageously increase the viscosity of the lubricating oil being released by the lubricant composition at higher temperatures when used in relatively small amounts (have a high thickening efficiency (TE)), provide reduced lubricating oil resistance at low temperatures and be resistant to mechanical degradation and reduction in molecular weight in use (have a low shear stability index (SSI)).

Preferably, a viscosity index improver increases the viscosity index of a base oil at least about 5% at a treat rate of 5% by weight. That is, if the base oil has a viscosity index of 100, a composition comprising 95% by weight base oil and 5% by weight viscosity index improver has a viscosity index of at least 105 as measured according to ASTM D2270.

Viscosity index (VI) improvers include polymers based on olefins, such as polyisobutylene, copolymers of ethylene and propylene (OCP) and other hydrogenated isoprene/butadiene copolymers, as well as the partially hydrogenated homopolymers of butadiene and isoprene and star copolymers and hydrogenated isoprene star polymers, polyalkyl (meth)acrylates, methacrylate copolymers, copolymers of an unsaturated dicarboxylic acid and a vinyl compound, interpolymers of styrene and acrylic esters, and hydrogenated copolymers of styrene/isoprene and styrene/butadiene. The molecular weight of polymers useful as viscosity index improver in accordance with the present invention can vary over a wide range since polymers having number-average molecular weights (Mn) as low as about 2,000 can affect the viscosity properties of an oleaginous composition. The preferred minimum Mn is about 10,000; the most preferred minimum is about 20,000. The maximum Mn can be as high as about 12,000,000; the preferred maximum is about 1,000,000; the most preferred maximum is about 750,000. An especially preferred range of number-average molecular weight for polymer useful as viscosity index improver in the present invention is from about 15,000 to about 500,000; preferably from about 20,000 to about 250,000; more preferably from about 25,000 to about 150,000. The number average molecular weight for such polymers can be determined by several known techniques. A convenient method for such determination is by size exclusion chromatography (also known as gel permeation chromatography (GPC)) that additionally provides molecular weight distribution information; see W. W. Yau, J. J. Kirkland and D. D. Bly, "Modern Size Exclusion Liquid Chromatography", John Wiley and Sons, New York, 1979.

The polydispersity index (Mw/Mn) of preferred polymers useful as viscosity index improver in accordance with the present invention is less than about 10, preferably less than about 5, more preferably less than about 4 and most preferably less than about 3 e.g., from 1.05 to 3.5, most preferably from 1.1 to 3. Mw is the weight average molecular weight of the polymer as measured by Gel Permeation Chromatography ("GPC") with a polystyrene standard.

"Thickening Efficiency" ("TE") is representative of a polymers ability to thicken oil per unit mass and is defined as:

$$TE = \frac{2}{c\ln 2}\ln\left(\frac{kv_{oil+polymer}}{kv_{oil}}\right)$$

Wherein c is polymer concentration (grams of polymer/100 grams solution), $kV_{oil+polymer}$ is kinematic viscosity of the polymer in the reference oil, and $kv_{oil}$ is kinematic viscosity of the reference oil. The TE is preferably measured at 100° C.

The viscosity index improver useful for the present invention preferably has a TE of from about 1.5 to about 4.0, preferably from about 1.6 to about 3.3, more preferably from about 1.7 to about 3.0.

"Shear Stability Index" ("SSI") measures the ability of polymers used as V.I. improvers in crankcase lubricants to maintain thickening power during use and is indicative of the resistance of a polymer to degradation under service conditions. The higher the SSI, the less stable the polymer, i.e. the more susceptible it is to degradation. SSI is defined as the percentage of polymer-derived viscosity loss and is calculated as follows:

$$SSI = 100 * \frac{kv_{fresh} - kv_{after}}{kv_{fresh} - kv_{oil}}$$

Wherein $kv_{oil}$ is the kinematic viscosity of the base oil, $kv_{fresh}$ is the kinematic viscosity of the polymer-containing solution before degradation and $kv_{after}$ is the kinematic viscosity of the polymer-containing solution after degradation. SSI is conventionally determined using ASTM D6278-98 (known as the Kurt-Orban (KO) or DIN bench test). The polymer under test is dissolved in suitable base oil (for example, solvent extracted 150 neutral) to a relative viscosity of 9 to 15 $mm^2s^{-1}$ (centistokes) at 100° C. and the resulting fluid is pumped through the testing apparatus specified in the ASTM D6278-98 protocol for 30 cycles. As noted above, a 90 cycle shear stability test (ASTM D7109) was approved in 2004.

The shear stability index (SSI, 30 cycles) according to ASTM D6278-98 of preferred polymers useful as viscosity index improver in accordance with the present invention is preferably less than about 60%, more preferably less than about 50%, more preferably less than about 40%. Preferred ranges are e.g. from about 1% to about 60%, preferably from about 2% to about 50%, more preferably from about 5% to about 40%.

Polymers based on olefins include monomers consisting of carbon atoms and hydrogen atoms, such as ethylene, propylene, butylene and diene monomers, such as butadiene. Preferably, the polymers based on olefins comprise at least 30 wt. %, more preferably at least 50 wt. % and most preferably at least 80 wt. % repeating units being derived from olefin monomers. Preferred olefin copolymers (or OCP) useful as viscosity index improvers conventionally comprise copolymers of ethylene, propylene and, optionally, a diene. Small polymeric side chains do not exert a substantial viscosity modifying effect in oil. Polymerized propylene has one methyl branch for every two backbone carbon atoms. Ethylene polymer is substantially straight chained. Therefore, at a constant amount of polymer in oil (treat rate), an OCP having a higher ethylene content will display an increased high temperature thickening effect (thickening efficiency, or TE). However, polymer chains having long ethylene sequences have a more crystalline polymer structure.

Due to their molecular architecture, star polymers are known to provide improved shear stability compared to OCPs. VI improvers that are star polymers made by hydrogenation of anionically polymerized isoprene are commercially available. Anionic polymerization results in a relatively low molecular weight distribution (Mw/Mn). Hydrogenation results in alternating ethylene/propylene units having a composition comparable to a polymer derived from 40 wt. % ethylene and 60 wt. % propylene. These VI improvers provide excellent shear stability, good solubility and excellent cold temperature properties.

Preferred polymers based on olefins are disclosed in EP0440506, EP1493800 and EP1925657. The documents EP0440506, EP1493800 and EP1925657 are expressly incorporated herein by reference for their disclosure regarding viscosity index improvers based on olefins.

Polyalkyl (meth)acrylates are based on alkyl (meth)acrylate monomers conventionally comprising 1 to 4000 carbon atoms in the alkyl group of the (meth)acrylates. Preferably, the polyalkyl (meth)acrylates are copolymers of alkyl (meth) acrylate monomers having 1 to 4 carbon atoms in the alkyl group, such as methyl methacrylate, ethyl methacrylate and propyl methacrylate and alkyl (meth)acrylate monomers having 8 to 4000 carbon atoms, preferably 10 to 400 carbon atoms and more preferably 12 to 30 carbon atoms in the alkyl group. Preferred polyalkyl (meth)acrylates are described in the U.S. Pat. No. 5,130,359 and U.S. Pat. No. 6,746,993. The U.S. Pat. No. 5,130,359 and U.S. Pat. No. 6,746,993 are expressly incorporated herein by reference for their disclosure regarding viscosity index improvers based on polyalkyl (meth)acrylates.

Preferably, the viscosity index improver may comprise dispersing groups. Dispersing groups including nitrogen-containing and/or oxygen-containing functional groups are well known in the art. Regarding functional groups nitrogen-containing groups are preferred. One trend in the industry has been to use such "multifunctional" VI improvers in lubricants to replace some or all of the dispersant. Nitrogen-containing functional groups can be added to a polymeric VI improver by grafting a nitrogen- or hydroxyl-containing moiety, preferably a nitrogen-containing moiety, onto the polymeric backbone of the VI improver (functionalizing). Processes for the grafting of a nitrogen-containing moiety onto a polymer are known in the art and include, for example, contacting the polymer and nitrogen-containing moiety in the presence of a free radical initiator, either neat, or in the presence of a solvent. The free radical initiator may be generated by shearing (as in an extruder), or heating a free radical initiator precursor, such as hydrogen peroxide. In the context of polyalkyl (meth)acrylate polymers, polymers having functional groups, preferably nitrogen-containing functional groups can be achieved by using comonomers comprising nitrogen-containing groups such as dimethylaminoethyl methacrylate (U.S. Pat. No. 2,737,496 to E. I. Dupont de Nemours and Co.), dimethylaminoethylmethacrylamide (U.S. Pat. No. 4,021,357 to Texaco Inc.) or hydroxyethyl methacrylate (U.S. Pat. No. 3,249,545 to Shell Oil. Co).

The U.S. Pat. No. 2,737,496, U.S. Pat. No. 4,021,357, U.S. Pat. No. 3,249,545, U.S. Pat. No. 6,331,510, U.S. Pat. No. 6,204,224, U.S. Pat. No. 6,372,696 and WO 2008/055976 are expressly incorporated herein by reference for their disclosure regarding multifunctional viscosity index improvers.

The amount of nitrogen-containing monomer will depend, to some extent, on the nature of the substrate polymer and the level of dispersancy required of the polymer. To impart dispersancy characteristics to copolymers, the amount of nitrogen-containing and/or oxygen-containing monomer is suitably between about 0.4 and about 10 wt. %, preferably from about 0.5 to about 5 wt. %, most preferably from about 0.6 to about 2.2 wt. %, based on the total weight of polymer.

Methods for grafting nitrogen-containing monomer onto polymer backbones, and suitable nitrogen-containing grafting monomers are known and described, for example, in U.S. Pat. No. 5,141,996, WO 98/13443, WO 99/21902, U.S. Pat. No. 4,146,489, U.S. Pat. No. 4,292,414, and U.S. Pat. No. 4,506,056. (See also J Polymer Science, Part A: Polymer Chemistry, Vol. 26, 1189-1198 (1988); J. Polymer Science, Polymer Letters, Vol. 20, 481-486 (1982) and J. Polymer Science, Polymer Letters, Vol. 21, 23-30 (1983), all to Gaylord and Mehta and Degradation and Crosslinking of Ethylene-Propylene Copolymer Rubber on Reaction with Maleic Anhydride and/or Peroxides; J. Applied Polymer Science, Vol. 33, 2549-2558 (1987) to Gaylord, Mehta and Mehta. The U.S. Pat. No. 5,141,996, U.S. Pat. No. 4,146,489, U.S. Pat. No. 4,292,414, U.S. Pat. No. 4,506,056, WO 98/13443 and WO 99/21902 are expressly incorporated herein by reference for their disclosure regarding multifunctional viscosity index improvers.

The viscosity index improvers can be used as a single polymer or as a mixture of different polymers, for example, a combination of a polymer based on an olefin, such as polyisobutylene, copolymers of ethylene and propylene (OCP) and other hydrogenated isoprene/butadiene copolymers, as well as the partially hydrogenated homopolymers of butadiene and isoprene and/or star copolymers and hydrogenated isoprene star polymers, preferably a copolymer of ethylene and propylene (OCP) with an VI improver comprising polymethacrylates, methacrylate copolymers, copolymers of an unsaturated dicarboxylic acid and a vinyl compound, interpolymers of styrene and acrylic esters, and/or hydrogenated copolymers of styrene/isoprene and/or styrene/butadiene. Preferably a mixture of at least one polymer based on olefins, preferably copolymers of ethylene and propylene (OCP) and of at least one polyalkyl (meth) acrylate can be used.

The lubricant composition may preferably contain a VI improver useful for the invention in an amount of from about 0 wt. % to about 30 wt. %, preferably from about 0.3 wt. % to about 25 wt. %, more preferably from about 0.4 wt. % to about 15 wt. %, stated as mass percent active ingredient (AI) in the total lubricating oil composition.

The viscosity index improvers are widely generally sold in the market as commercial products. For example, there are commercial products of VISCOPLEX® (by Evonik Rohmax GmbH) and ACLUBE® (by Sanyo Chemical) as a poly(meth)acrylate reagent. Infineum® V534 and Infineum® V501 available from Infineum USA L.P. and Infineum UK Ltd. are examples of commercially available amorphous OCP. Other examples of commercially available amorphous OCP VI improvers include Lubrizol® 7065 and Lubrizol® 7075, available from The Lubrizol Corporation; Jilin® 0010, available from PetroChina Jilin Petrochemical Company; and NDR0135, available from Dow Elastomers L.L.C. An example of a commercially available star polymer VI improver having an SSI equal to or less than 35 is Infineum® SV200, available from Infineum USA L.P. and Infineum UK Ltd. Other examples of commercially available star polymer VI improver having an SSI equal to or less than 35 include Infineum® SV250, and Infineum® SV270, also available from Infineum USA L.P. and Infineum UK Ltd.

Multifunctional viscosity index improvers are available from Evonik Rohmax GmbH under the trade designations "Acryloid 985", "Viscoplex 6-054", "Viscoplex 6-954" and "Viscoplex 6-565" and from The Lubrizol Corporation under the trade designation "LZ 7720C".

The present lubricant composition may comprise further additives. Preferably, these additives comprise a low content of sulfur or phosphorus. These additives include friction modifiers, antioxidants, anti-corrosion additives, bases, demulsifiers, dispersants, overbased detergents, extreme pressure additives and pour point depressants.

Non-excluding examples of friction modifiers are for instance fatty acid esters and fatty amine salts of benzotriazole. Non-excluding examples of surfactants are for instance sarcosinates, sulfonates and octadecenyl amine. Non-excluding examples of anti-corrosion additives are organic boronic acid ester and dinonyl diphenylamine. Non-excluding examples of anti-corrosive additives are for instance fatty acid amides, succinimide and succinimide boride. Non-excluding examples of viscosity modifiers are olefinic macromers and copolymers. Non-excluding examples of overbased detergents are colloidal inorganic particles like for instance carbonates and alkyl salicylates based on calcium or magnesium.

As antioxidants, hindered phenols or amines, for example phenyl alpha naphthylamine are generally used. Demulsifiers that are generally applied are polyalkylene glycol ethers. Preferred friction modifiers are compounds based on poly (meth)acrylates as described in WO A 2004/087850, WO 2006/105926, WO 2006/007934 and WO 2005/097956. The documents WO A 2004/087850, WO 2006/105926, WO 2006/007934 and WO 2005/097956 are expressly incorporated herein by reference for their disclosure regarding poly(meth)acrylates useful as friction modifiers. Furthermore, polymers such as nanoparticulate polytetrafluoroethylene can be added as described e.g. in US 2011/306527 A1. The document US 2011/306527 A1 is expressly incorporated herein by reference for its disclosure regarding compositions comprising nanoparticulate polytetrafluoroethylene.

Dispersants maintain oil insolubles, resulting from oxidation during use, in suspension in the fluid thus preventing slide glocculation and precipitation or deposition on metal parts. Suitable dispersants include high molecular weight alkyl succinimides, the reaction product of oil-soluble polyisobutylene succinic anhydride with ethylene amines such as tetraethylene pentamine and borated salts thereof.

The ashless dispersants include the polyalkenyl or borated polyalkenyl succinimide where the alkenyl groups are derived from a $C_3$-$C_4$ olefin, especially polyisobutenyl having a number average molecular weight of 700 to 5,000. Other well-known dispersants include ethylene-propylene oligomers with N/O functionalities and oil soluble polyol esters of hydrocarbon substituted succinic anhydride, e.g. polyisobutenyl succinic anhydride, and the oil soluble oxazoline and lactone oxazoline dispersants derived from hydrocarbon substituted succinic anhydride and disubstituted amino alcohols. Lubricating oils preferably contain 0.5 to 5 wt. % of ashless dispersant.

The pour point improvers include especially polyalkyl (meth)acrylates (PAMA) having 1 to 30 carbon atoms in the alcohol group, $C_8$ to $C_{18}$ dialkyl fumarate/vinyl acetate copolymers and chlorinated paraffin-naphthalane condensation products. Lubricating oils preferably contain up to 5 wt. %, more preferably 0.01 to 1.5 wt. % of pour point improvers. These are widely generally sold in the market as commercial products. For example, there are commercial products of VISCOPLEX® (by Evonik Rohmax GmbH), ACLUBE® (by Sanyo Chemical) and PLEXOL® (by Nippon Acryl) as a poly(meth)acrylate reagent; and commercial products of LUBRAN® (by Toho Chemical) as a chlorinated paraffin-naphthalane condensation product. Preferred are poly(meth)acrylates.

Compilations of VI improvers and pour point improvers for lubricant oils are also detailed in T. Mang, W. Dresel (eds.): "Lubricants and Lubrication", Wiley-VCH, Weinheim 2001: R. M. Mortier, S. T. Orszulik (eds.): "Chemistry and Technology of Lubricants", Blackie Academic & Professional, London, 2nd ed. 1997; or J. Bartz: "Additive für Schmierstoffe", Expert-Verlag, Renningen-Malmsheim 1994. These references also disclose other additives mentioned above and below.

Table 3 shows preferred compositions for lubricants according to the present invention.

TABLE 3

| | Amount in wt. % preferred | Amount in wt. % more preferred |
|---|---|---|
| base oil | 50 to 98.0 | 60 to 95.0 |
| viscosity index improver | 0 to 30.0 | 1 to 20.0 |
| ashless dispersant | 0 to 7.0 | 0.5 to 5 |
| pour point improver | 0 to 5.0 | 0.01 to 1.5 |
| lubricant additive composition according to the present invention | 0.05 to 20.0 | 0.2 to 10 |
| | Amount in wt. % even more preferred | Amount in wt. % most preferred |
| base oil | 50 to 99.0 | 60 to 98.0 |
| viscosity index improver | 0 to 30.0 | 1 to 20.0 |
| ashless dispersant | 0 to 7.0 | 0.5 to 5 |
| pour point improver | 0 to 5.0 | 0.01 to 1.5 |
| lubricant additive composition according to the present invention | 0.01 to 5.0 | 0.1 to 2 |

Preferably, the overall formulation is prepared so that the additive wt. % levels of the components between these ranges are selected to provide at least 80 wt. %, more preferably 100 wt. % for the final formulation.

TABLE 3a

Additional preferred compositions for lubricants according to the present invention

| | Amount in wt. % preferred | Amount in wt. % more preferred |
|---|---|---|
| base oil | 50 to 99.0 | 60 to 98.0 |
| viscosity index improver | 0 to 30.0 | 1 to 20.0 |
| ashless dispersant | 0 to 7.0 | 0.5 to 5 |
| pour point improver | 0 to 5.0 | 0.01 to 1.5 |
| detergent | 0 to 30.0 | 0 to 25.0 |
| antioxidant | 0 to 5.0 | 0 to 3.0 |
| anti-wear agent | 0 to 5.0 | 0 to 3.0 |
| friction modifier | 0 to 5.0 | 0 to 3.0 |
| corrosion inhibitor | 0 to 5.0 | 0 to 3.0 |
| demulsifier | 0 to 1.0 | 0 to 0.5 |
| antifoam | 0 to 1.0 | 0 to 0.5 |
| lubricant additive composition according to the present invention | 0.05 to 20.0 | 0.2 to 10 |

Note -
The overall formulation is prepared so that the additive wt. % levels of the components between these ranges are selected to provide 100 wt. % for the final formulation.

Note—The overall formulation is prepared so that the additive wt. % levels of the components between these ranges are selected to provide 100 wt. % for the final formulation.

TABLE 3b

Additional preferred compositions for lubricants according to the present invention

| | Amount in wt. % even more preferred | Amount in wt. % most preferred |
|---|---|---|
| base oil | 50 to 99.0 | 60 to 98.0 |
| viscosity index improver | 0 to 30.0 | 1 to 20.0 |
| ashless dispersant | 0 to 7.0 | 0.5 to 5 |
| pour point improver | 0 to 5.0 | 0.01 to 1.5 |
| detergent | 0 to 20.0 | 0 to 15.0 |
| antioxidant | 0 to 2.0 | 0 to 1.0 |
| | Amount in wt. % even more preferred | Amount in wt. % most preferred |
| anti-wear agent | 0 to 2.0 | 0 to 1.0 |
| friction modifier | 0 to 2.0 | 0 to 1.0 |
| corrosion inhibitor | 0 to 2.0 | 0 to 1.0 |
| demulsifier | 0 to 0.3 | 0 to 0.2 |
| antifoam | 0 to 0.2 | 0 to 0.1 |
| lubricant additive composition according to the present invention | 0.01 to 5.0 | 0.1 to 2 |

Note -
The overall formulation is prepared so that the additive wt. % levels of the components between these ranges are selected to provide 100 wt. % for the final formulation.

Note—The overall formulation is prepared so that the additive wt. % levels of the components between these ranges are selected to provide 100 wt. % for the final formulation.

Preferably, the sulfur content of the lubricant composition is identical or smaller than the sulfur content of the base oil. No sulfur containing additives are needed or added.

Preferably, the lubricant composition comprises at most 0.05 wt. %, especially at most 0.03 wt. %, preferably at most 0.01 wt. %, more preferably at most 0.003 wt. %, more preferably at most 0.002 wt. % and most preferably at most 0.001 wt. % of phosphorus. The amount of phosphorus in the lubricant composition should be as low as possible in order to improve the environmental acceptability. The amount of phosphorus can be determined according to ASTM D1091.

Preferably, the phosphorus content of the lubricant composition is identical or smaller than the phosphorus content of the base oil. No phosphorus containing additives are needed or added.

According to a preferred aspect of the present invention the lubricant composition preferably comprises at most 0.2 wt. %, especially at most 0.1 wt. %, more preferably at most 0.05 wt. %, more preferably at most 0.03 wt. %, more preferably at most 0.02 wt. % and most preferably at most 0.01 wt. % of sulfated ash. The amount of sulfated ash in the lubricant composition should be as low as possible in order to improve the environmental acceptability. The amount of sulfated ash can be determined according to ASTM D874.

Preferably, the sulfated ash of the lubricant composition is identical or smaller than the sulfated ash of the base oil.

Preferably, the lubricant composition comprises at most 0.05 wt. %, especially at most 0.03 wt. %, preferably at most 0.01 wt. %, more preferably at most 0.003 wt. %, more preferably at most 0.002 wt. % and most preferably at most 0.001 wt. % of halogenides, especially chlorides and bromides, based on the halogenide element weight of the halogenide compound, e.g. the weight of chloride element in a chloride salt. The amount of halogenides in the lubricant composition should be as low as possible in order to reduce wear.

Preferably, the halogenide content of the lubricant composition is identical or smaller than the halogenide content of the base oil. No halogenide containing additives are needed or added.

The low amount of sulfur, phosphorus and sulfated ash in the lubricant composition can be obtained by using base oils having low sulfur and low phosphorus content and by omitting sulfur and phosphorus containing additives. It should be noted that prolongation of the lifespan of machines, engines and motors by reducing temperatures of friction surfaces and improving abrasive resistance, thus reducing wear of their moving parts by using the present lubricant composition as mentioned above can surprisingly be improved by omitting conventional sulfur and/or phosphorus containing anti-wear and extreme pressure additives.

The compositions of this invention are used principally in the formulation of motor oils and in the formulation of crankcase lubricating oils for passenger car and heavy duty diesel engines, and comprise a major amount of an oil of lubricating viscosity, a VI improver, in an amount effective to modify the viscosity index of the lubricating oil, the lubricant additive composition as described above, and optionally other additives as needed to provide the lubricating oil composition with the required properties.

In general, the lubricant composition according to the present invention can be manufactured by any techniques known in the field, such as conventional mixing techniques, the different variations thereof being well known for those skilled in the art.

In a particular aspect of the present invention, preferred lubricant oil compositions have a viscosity index determined to ASTM D 2270 in the range of 100 to 400, more preferably in the range of 125 to 325 and most preferably in the range of 150 to 250.

Preferred lubricants have a PSSI to DIN 51350-6 (20 h, tapered roller bearing) less than or equal to 100. The PSSI is more preferably less than or equal to 65, especially preferably less than or equal to 25.

Lubricant oil compositions which are additionally of particular interest are those which preferably have a high-temperature high-shear viscosity HTHS measured at 150° C. of at least 2.4 mPas, more preferably at least 2.6 mPas, more preferably at least 2.9 mPas and most preferably at least 3.5 mPas. The high-temperature high-shear viscosity HTHS measured at 100° C. is preferably at most 10 mPas, more preferably at most 7 mPas and most preferably at most 5 mPas. The difference between the high-temperature high-shear viscosities HTHS measured at 100° C. and 150° C. $HTHS_{100}$-$HTHS_{150}$, is preferably at most 4 mPas, more preferably at most 3.3 mPas and most preferably at most 2.5 mPas. The ratio of high-temperature high-shear viscosity at 100° C. $HTHS_{100}$ to high-temperature high-shear viscosity at 150° C. $HTHS_{150}$, $HTHS_{100}/HTHS_{150}$, is preferably at most 2.0, more preferably at most 1.9. The high-temperature high-shear viscosity HTHS can be measured at the particular temperature to ASTM D4683.

The lubricant composition of the present invention can be preferably designed to meet the requirements of the SAE classifications as specified in SAE J300. E.g. the requirements of the viscosity grades 0W, 5W, 10W, 15W, 20W, 25W, 20, 30, 40, 50, and 60 (single-grade) and 0W-40, 10W-30, 10W-60, 15W-40, 20W-20 and 20W-50 (multi-grade) could be adjusted. In addition thereto, also the specification for transmission oils can be achieved such as defined, e.g. in the SAE classifications 75W-90 or 80W-90.

According to a special aspect of the present invention, the lubricant composition stays in grade after a shear stability test according to CEC L-014-93 at 100° C. after 30 cycles.

The lubricant composition of the present invention provides an excellent protection against wear and scuffing. Preferably, the tests according to CEC L-99-08 (OM646LA) are passed providing a cam wear outlet of at most 120 μm, a cam wear inlet of at most 100 μm and a cylinder wear of at most 5 μm.

Furthermore, the lubricant composition can be preferably designed to meet the requirements of the API classifications of the American Petroleum Institute. E.g. the requirements of the diesel engine service designations CJ-4, CI-4, CH-4, CG-4, CF-2, and CF can be achieved. Regarding the gasoline engines, the specifications API SJ, API SL and API SM can be realized. Regarding gear oils, the specifications of API GL1, API GL2, API GL3, API GL4 and API GL5 can be achieved.

In addition thereto, the lubricant composition can be designed to meet the requirements of the ACEA (Association des Constructeurs Européens d'Automobiles) regarding all oil types specified, e. g. ACEA Class $A1/B1_{-10}$, ACEA Class $A3/B3_{-10}$, ACEA Class $A3/B4_{-10}$, ACEA Class $A5/B5_{-10}$, ACEA Class $C1_{-10}$, ACEA Class $C2_{-10}$, ACEA Class $C3_{-10}$, ACEA Class $C4_{-10}$, ACEA Class $E4_{-08}$, ACEA Class $E6_{-08}$ and ACEA Class $E7_{-08}$ and ACEA Class $E9_{-08}$ according to the ACEA specifications 2010 as allowable from 22 Dec. 2010.

The present lubricants can be used especially as a transmission oil, motor oil or hydraulic oil. Surprising advantages can be achieved especially when the present lubricants are used in manual, automated manual, double clutch or direct-shift gearboxes (DSG), automatic and continuous variable transmissions (CVCs). In addition, the present lubricants can be used especially in transfer cases and axle or differential gearings.

A motor comprising a lubricant of the present composition usually comprises a lubricant having a low amount of viscosity index improver. Preferably the lubricating oil composition useful as motor oil may contain the VI improver of the invention in an amount of from about 0.1 wt. % to about 2.5 wt. %, preferably from about 0.3 wt. % to about 1.5 wt. %, more preferably from about 0.4 wt. % to about 1.3 wt. %, stated as mass percent active ingredient (AI) in the total lubricating oil composition.

A preferred motor comprises a catalyst system for cleaning the exhaust gases. Preferably the motor fulfills the exhaust emission standard for modern diesel or gasoline motors such as Euro 4, Euro 5 and Euro 6 in the European Union and Tier 1 and Tier 2 in the United States of America.

The present invention further provides a method of lubricating an internal combustion engine, in particular a diesel engine, gasoline engine and a gas-fuelled engine, with a lubricating composition as hereinbefore described. This includes engines equipped with exhaust gas recirculation (EGR).

The lubricant composition of the present invention exhibits surprisingly good piston cleanliness, wear protection and anticorrosion performance in EGR engines.

In particular, lubricant composition according to the present invention surprisingly meets the API CI-4 requirements (ASTM D4485-03a; Standard Specification for Performance of Engine Oils) despite having the afore-mentioned sulfur content, phosphorus content and sulfated ash content.

Furthermore, the lubricating oil composition of the present invention exhibits surprisingly good piston cleanliness, wear protection and anticorrosion performance in Daimler-Chrysler and MAN engines. In particular, lubricant compositions according to the present invention can be preferably designed to pass the requirements of ACEA E4, DC 228.5 and MAN M3277 performance specifications.

A gearbox comprising a lubricant of the present composition usually comprises a lubricant having a high amount of viscosity index improver. Preferably the lubricating oil composition useful as gearbox oil may contain the VI improver in an amount of from about 1 wt. % to about 30 wt. %, preferably from about 2 wt. % to about 25 wt. %, more preferably from about 3 wt. % to about 15 wt. %, stated as mass percent active ingredient (AI) in the total lubricating oil composition.

A further subject matter of the present invention is a grease composition comprising an additive composition of the present invention as disclosed above and below. Here, a grease composition means a substance introduced between moving surfaces to reduce the friction between them, i.e. a grease composition is any kind of a natural or a synthetic lubricating substance having a semisolid or plastic consistency. Without being bound to theory, the inventors believe that the compounds of the grease composition of the present invention react on frictions surfaces and form a non-oxidising thin metal film on said surfaces, thus reducing mechanical wear and tear of the surfaces the grease composition has been applied on. Therefore, the inventors believe that the grease composition can be classified as a metal-coating composition.

The grease composition of the present invention preferably comprises a base oil component, at least one thickener and at least one lubricant additive composition according to the present invention as disclosed above and below.

The amount of lubricant additive composition comprised in the grease may vary over a broad range. Furthermore, it is obvious to a person skilled in the art that grease according to the present invention can be obtained by in situ forming the components of the lubricant additive composition. Therefore, a further subject matter of the present invention is grease comprising a first metal component and particles, preferably nanoparticles including a second metal component.

Preferably, the grease comprises 0.05 to 20% by weight a lubricant additive composition, more preferably 0.1 to 10% by weight and especially preferably 0.3 to 5%. More preferably, the grease comprises 0.005 to 15% by weight particles, preferably nanoparticles comprising the second metal component, more preferably 0.01 to 8% by weight and especially preferably 0.03 to 3%. More preferably, the lubricant composition comprises 0.0001 to 15% by weight particles, preferably nanoparticles comprising the second metal component, more preferably 0.0005 to 8% by weight and especially preferably 0.001 to 3%. More preferably, the grease comprises 0.005 to 15% by weight of the first metal component, more preferably 0.01 to 8% by weight and especially preferably 0.03 to 3%. More preferably, the grease comprises 0.00005 to 15% by weight of the first metal component, more preferably 0.0001 to 8% by weight and especially preferably 0.0005 to 3%.

Preferably, the grease comprises about 0.005 to 10% by weight of particles, preferably nanoparticles comprising the second metal component, more preferably 0.01 to 5% by weight and especially preferably 0.1 to 3% by weight. More preferably, the grease comprises 0.0001 to 15% by weight particles, preferably nanoparticles being obtainable by the method of the present invention, more preferably 0.0005 to 4% by weight and especially preferably 0.001 to 1%.

In addition to the base oil, the present grease composition preferably comprises a thickener. These thickeners include thickeners on the basis of soap, thickeners on the basis of a polymer and/or inorganic thickeners.

The thickeners are known per se in the technical field and can be obtained commercially. These are, inter alia, in Ullmann's Encyclopedia of Industrial Chemistry, Sixth Edition, Vol. 20, 2003, Wiley, ISBN 3-527-30385-5, in T. Mang and W. Dresel, Lubricants and Lubrication, 2001, Wiley, ISBN 3-527-29536-4, and Wilfried J. Bartz et al., Schmierfette, expert-Verl., 2000, ISBN 3-8169-1533-7.

The greases according to the invention are preferably thickened with soaps, preferably metal soaps of fatty acids, which may be prepared separately or in situ during the making of the grease (in the latter case, the fatty acid is dissolved in the base oil and the suitable metal hydroxide is then added). These thickeners are easily available and inexpensive products currently used in the field of greases.

Long chain fatty acids are preferentially used, typically comprising from 10 to 28 carbon atoms, either saturated or unsaturated, optionally hydroxylated. The long chain fatty acids (typically comprising from 10 to 28 carbon atoms) are for example, capric, lauric, myristic, palmitic, stearic, arachidic, behenic, oleic, linoleic, erucic acids and their hydroxylated derivatives. 12-hydroxystearic acid is the most well-known derivative of this category, and preferred. These long chain fatty acids generally derive from vegetable oils, for example palm, castor, rapeseed, sunflower oil or from animal fats (tallow, whale oil).

So-called simple soaps may be formed by using one or more long chain fatty acids. It is also possible to form so-called complex soaps by using one or more long chain fatty acids in combination with one or more carboxylic acids with a short hydrocarbon chain comprising at most 8 carbon atoms.

The saponification agent used for making the soap may be a metal compound of lithium, sodium, calcium, barium, titanium, aluminum, preferentially lithium and calcium, and preferably a hydroxide, oxide or carbonate of these metals. One or more metal compounds may be used, either having the same metal cation or not, in the greases according to the invention. It is thereby possible to associate lithium soaps combined with calcium soaps in a lesser proportion.

Preferably a lithium complex thickener can be used in the present grease composition. For example, the lithium complex thickener can comprise a lithium soap derived from a fatty acid containing an epoxy group and/or ethylenic unsaturation and a dilithium salt derived from a straight chain dicarboxylic acid and/or, in one embodiment, a lithium salt derived from a hydroxy-substituted carboxylic acid such as salicylic acid.

According to a preferred embodiment of the present invention, the thickener can be a lithium soap or a lithium complex soap prepared from hydroxy fatty acid having from 12 to 24 carbon atoms.

Preferably, the thickener can be a complex of a lithium soap of a C12 to C24 hydroxy fatty acid and a monolithium salt of boric acid and can include a lithium salt of a second hydroxy carboxylic acid such as salicylic acid.

The complex can comprise a lithium soap of a $C_{12}$ to $C_{24}$ hydroxy fatty acid thickener antioxidant comprising an alkali metal salt of hydroxy benzoic acid and a diozime compound. The alkali metal salt of hydroxy benzoic acid include dilithium salicylate.

The complex can be a lithium soap which is a combination of a dilithium salt of a $C_4$ to $C_{12}$ dicarboxylic acid, e.g., dilithium azelate, a lithium soap of a 9-, 10- or 12-hydroxy $C_{12}$ to $C_{24}$ fatty acid, e.g., lithium 12-hydroxy stearate; and a lithium salt formed in-situ in the grease from a second hydroxy carboxylic acid wherein the —OH group is attached to a carbon atom not more than 6 carbons removed from the carboxyl group and wherein either of those groups may be attached to either aliphatic or aromatic portions of the materials.

Or, the lithium complex can comprise a combination of a complex lithium soap thickener, a lithium salt of a $C_3$ to $C_{14}$ hydroxycarboxylic acid and a thiadiazole. The grease may also optionally and preferably contain additional antioxidants, preferably amine type or phenol type anti-oxidants, most preferably amine type antioxidants.

In one embodiment, the lithium complex thickener is simply a lithium salt of a carboxylic acid, such as stearic acid and oleic acid, and in particular a hydroxycarboxylic acid, such as hydroxystearic acid. Such a thickener can be prepared, for example, by reacting lithium hydroxyl monohydrate with the hydroxystearic acid, stearic acid and/or oleic acid.

According to a preferred embodiment the thickener preferably include a lithium soap of 12-oxystearic acid and a lithium soap of oleic acid. More preferably, the weight ratio of the lithium soap of 12-oxystearic acid to the lithium soap of oleic is in the range of 10:1 to 1:2, more preferably 5:1 to 1:1 and most preferably 4:1 to 2:1.

Thickeners based on polymers include polycarbamides (polyureas) and polytetrafluoroethylene. Thickeners based on urea compounds are disclosed in WO 2011/020863 A1. Furthermore, greases comprising polymeric thickeners are disclosed in WO 2012/076025 A1. The documents WO 2011/020863 A1 and WO 2012/076025 A1 are expressly incorporated herein by reference for their disclosure regarding thickeners based on polymers.

Furthermore, inorganic thickeners can be applied such as bentonite, amorphous hydrophilic silicon oxide particles and silica gel. Preferably silica particles having a mean particle size in the range of 5 to 50 nm can be used as described in US 2012/149613 A1. The document US 2012/149613 A1 is expressly incorporated herein by reference for its disclosure regarding silica particles useful as thickeners.

The thickener mentioned above can be used as a single compound or as a mixture of different compounds being classified in the same class or as mixtures of thickeners being classified in different classes.

Regarding the choice of thickener, thickeners being based on soaps are preferred over thickeners based on polymers or inorganic thickeners.

The weight ratio of base oil to thickener in the grease composition is known per se and is described in the literature mentioned above and below. In general, this ratio depends on the NLGI consistency number according to DIN 51818 and is in the range from 100:1 to 100:30, preferably 100:2 to 100:25, in particular 100:5 to 100:15.

For example, metal soaps are preferably used at contents of the order of 1 to 60% by weight, preferentially from 2 to 50% or further from 4 to 40% or from 4.5 to 30% by weight in the greases according to the invention. When applications such as lubricated bearings or centralized greasing for automobiles are targeted, the use of 1 to 6%, preferentially 2 to 5% of metal soap(s) will be preferred, so as to obtain fluid or semi-fluid greases of grade 000 or 00 according to the NLGI classification. When applications such as transmissions are targeted, the use of 6.5% to 15%, preferentially 7 to 13% or 8 to 12% of metal soap(s) will be preferred, so as to obtain greases of grade 0, grade 1 or grade 2 according to the NLGI classification. These thickener contents are relatively low in the greases according to the invention, so as to obtain greases for which the consistency corresponds to a grade comprised between 000, 00, 0, 1 or 2 according to the NLGI classification, and to promote an increase in the yield, energy savings or an ecofuel effect, for example on systems such as lubricated rolling bearings, centralized greasing systems for vehicles or transmissions.

According to a special aspect of the present invention, the grease composition may preferably comprise about 8-12 weight percent (wt. %) lithium soap of 12-oxystearic acid and 1.5-3.0 wt. % lithium soap of oleic acid 1.5-3.0.

Higher amounts of thickeners or the use of further additives will lead to greases having a higher grade according to the NLGI classification, such as grade 3, grade 4, grade 5 or grade 6. For example, the thickening activity of some thickeners can be increase by using of copolymer as an additive. These copolymers are commonly used as viscosity index improvers and are described below. The copolymer can be a hydrocarbon based copolymer such as a copolymer of styrene and butadiene or ethylene and propylene. In one embodiment, the copolymer additive is a copolymer of styrene and butadiene. It has been found that use of a small amount of such a copolymer, e.g. from 2-6 weight percent, or from 2-5 weight percent, or in another embodiment, from 3-4 weight percent, in combination with a lithium complex thickener, results in a 25-50% increase in thickener yield.

Preferably, the greases will comprise a major amount, e.g., greater than 50% by weight of the base oil, and a minor amount of the thickener and any other additives, i.e. less than 50% by weight. The greases of the present invention may, of course, contain any of the other, typical grease additives such as rust inhibitors, barium dinonyl naphtheline fulfonate, order modifiers, tackiness agents, extreme pressure agents, water shedding agents, dyes, etc. Typical additives and their function are described in Modem Lubricating Greases by C. J. Boner, Scientific Publication (G.B.) Ltd. 1976.

Preferably, a grease according to the present invention may comprise a viscosity index improver as mentioned above and below, especially as described in connection with a lubricant composition. The U.S. Pat. No. 5,116,522, US 2005/245406 A1, US 2007/191238 A1 and US 2012/004153 A1 are expressly incorporated herein by reference for their disclosure regarding viscosity index improvers, thickener and/or structure improvers.

Table 4 shows preferred compositions for greases according to the present invention.

TABLE 4

| | Amount in wt. % preferred | Amount in wt. % more preferred |
|---|---|---|
| base oil | 50 to 98.0 | 60 to 95.0 |
| thickener | 0.1 to 60 | 1 to 40 |
| lubricant additive composition according to the present invention | 0.05 to 20.0 | 0.2 to 10 |

| | Amount in wt. % even more preferred | Amount in wt. % most preferred |
|---|---|---|
| base oil | 50 to 98.0 | 60 to 95.0 |
| thickener | 0.1 to 60 | 1 to 40 |
| lubricant additive composition according to the present invention | 0.01 to 4.0 | 0.1 to 2 |

Preferably, the overall formulation is prepared so that the additive wt. % levels of the components between these ranges are selected to provide at least 80 wt. %, more preferably 100 wt. % for the final formulation.

TABLE 4a

Additional preferred compositions for greases according to the present invention

| | Amount in wt. % preferred | Amount in wt. % more preferred |
|---|---|---|
| base oil | 50 to 98.0 | 60 to 95.0 |
| thickener | 0.1 to 60 | 1 to 40 |
| antioxidant | 0 to 15 | 0 to 10 |
| corrosion/rust inhibitor | 0 to 15 | 0 to 10 |
| lubricant additive composition according to the present invention | 0.05 to 20.0 | 0.2 to 10 |

Note -
The overall formulation is prepared so that the additive wt. % levels of the components between these ranges are selected to provide 100 wt. % for the final formulation.

Note—The overall formulation is prepared so that the additive wt. % levels of the components between these ranges are selected to provide 100 wt. % for the final formulation.

TABLE 4b

Additional preferred compositions for greases according to the present invention

| | Amount in wt. % even more preferred | Amount in wt. % most preferred |
|---|---|---|
| base oil | 60 to 98.0 | 60 to 95.0 |
| thickener | 1 to 40 | 1 to 40 |
| antioxidant | 0 to 5 | 0 to 3 |
| corrosion/rust inhibitor | 0 to 5 | 0 to 3 |
| lubricant additive composition according to the present invention | 0.05 to 20.0 | 0.2 to 10 |

Note -
The overall formulation is prepared so that the additive wt. % levels of the components between these ranges are selected to provide 100 wt. % for the final formulation.

The grease composition preferably comprises a NLGI consistency number according to DIN 51818 from 000 to 6, especially from 00 to 6, preferably from 0 to 6 and more preferably from 1 to 5.

According to a special aspect of the present invention, the grease composition comprises a drop point of at least 180° C., more preferably at least 190° C. according to DIN ISO 2176.

Preferred lubricating grease compositions are preferably suitable for applications for upper service temperatures of more than 120° C. up to 260° C. and for low service temperatures of −60° C. according to DIN 51285. They may also be used at upper service temperatures of more than 180° C. and for low service temperatures down to 60° C. according to DIN 51825.

Preferably, the grease composition comprises at most 0.2 wt. %, especially at most 0.1 wt. %, preferably at most 0.05 wt. %, more preferably at most 0.03 wt. %, more preferably at most 0.02 wt. % and most preferably at most 0.01 wt. % of sulfur. The amount of sulfur in the lubricant composition should be as low as possible in order to improve the environmental acceptability. The amount of sulfur can be determined according to ASTM D4294.

Preferably, the sulfur content of the grease composition is identical or smaller than the sulfur content of the base oil. No sulfur containing additives are needed or added.

Preferably, the grease composition comprises at most 0.05 wt. %, especially at most 0.03 wt. %, preferably at most 0.01 wt. %, more preferably at most 0.003 wt. %, more preferably at most 0.002 wt. % and most preferably at most 0.001 wt. % of phosphorus. The amount of phosphorus in the grease composition should be as low as possible in order to improve the environmental acceptability. The amount of phosphorus can be determined according to ASTM D1091.

Preferably, the phosphorus content of the grease composition is identical or smaller than the phosphorus content of the base oil. No phosphorus containing additives are needed or added.

According to a preferred aspect of the present invention the grease composition comprises at most 0.2 wt. %, especially at most 0.1 wt. %, preferably at most 0.05 wt. %, more preferably at most 0.03 wt. %, more preferably at most 0.02 wt. % and most preferably at most 0.01 wt. % of sulfated ash. The amount of sulfated ash in the grease composition should be as low as possible in order to improve the environmental acceptability. The amount of sulfated ash can be determined according to ASTM D874.

Preferably, the sulfated ash of the grease composition is identical or smaller than the sulfated ash of the base oil.

Preferably, the grease composition comprises at most 0.05 wt. %, especially at most 0.03 wt. %, preferably at most 0.01 wt. %, more preferably at most 0.003 wt. %, more preferably at most 0.002 wt. % and most preferably at most 0.001 wt. % of halogenides, especially chlorides and bromides, based on the halogenide element weight of the halogenide compound, e.g. the weight of chloride element in a chloride salt. The amount of halogenides in the lubricant composition should be as low as possible in order to reduce wear.

Preferably, the halogenide content of the grease composition is identical or smaller than the halogenide content of the base oil. No halogenide containing additives are needed or added.

The low amount of sulfur, phosphorus and sulfated ash in the grease composition can be obtained by using base oils having low sulfur and low phosphorus content and by omitting sulfur and phosphorus containing additives. It should be noted that prolongation of the lifespan of moving parts, such as bearings, by reducing temperatures of friction surfaces and improving abrasive resistance, thus reducing wear of their moving parts by using the present lubricant composition as mentioned above can surprisingly be improved by omitting conventional sulfur and/or phosphorus containing anti-wear and extreme pressure additives.

The compositions of this invention are used principally in the formulation of bearing greases and in the formulation of chassis greases, and comprise a major amount of an oil of lubricating viscosity, a thickener, and the lubricant additive composition as described above, and optionally other additives as needed to provide the grease composition with the required properties.

Preferably, a lubricating grease may stimulate vibrations in the roller bearing which are in the medium-frequency band from 300 to 1800 Hz and high-frequency band 1800 to 10,000 Hz in revolving participation (rolling over, milling) in comparison with the bearing noise in the low-frequency band at 50 to 300 Hz. Superimposed on the lubricant noise are sound peaks occurring with rollover of hard particles by the roller bearing in the form of shock pulses on the bearing ring. The sound performance is evaluated according to the SKF BeQuiet method based on a static analysis of the noise peaks and the assignment to the noise classes BQ1 to BQ4. With increasing values of the noise class, the noise behavior becomes worse and the lifetime of the roller bearing is shortened (H. Werries, E. Paland, FVA study of the topic "Low-noise lubricating greases," University of Hanover 1994). Thus, 100% noise class BQ1 characterizes a very good noise behavior and low percentage values exclusively in noise class BQ4 characterize very poor noise behavior.

The better the noise behavior of a lubricating grease, the lower are the vibrations of the bearing induced by the lubricant. This is equivalent to a low load on the bearing and leads to a longer service lifetime of the bearing.

In general, the grease composition according to the present invention can be manufactured by any techniques known in the field, such as conventional mixing techniques, the different variations thereof being well known for those skilled in the art. Lubricating greases may be produced in batch processes or by continuous processes.

Preferably, the additive lubricant composition can be mixed with the base oil before the thickener is added to the base oil in order to achieve a grease composition of the present invention.

The U.S. Pat. No. 5,116,522 A and WO 2012/076025 A1 are expressly incorporated herein by reference for their disclosure regarding the preparation of grease compositions by batch processes.

According to a preferred embodiment, the present grease composition can be prepared by first dispersing or mixing the thickener in the lubricating oil for from about 1 to about 8 hours or more (preferably from about 1 to about 4 hours) followed by heating at elevated temperature (e.g., from about 60° C. to about 260° C. depending upon the particular thickener used) until the mixture thickens.

Furthermore, continuous processes are known to prepare grease compositions as described, e.g. in US 2007/191238A1. The document US 2007/191238A1 is expressly incorporated herein by reference for its disclosure regarding the preparation of grease compositions by continuous processes.

The present greases can be used especially as bearing grease and/or as chassis grease.

The mechanical component having a metal surface to be treated with the grease composition according to the present invention is preferably a bearing, bearing component or a bearing application system. The bearing component may be inner rings, outer rings, cages, rollers, balls and seal-counter faces. The bearing application system in accordance with the present invention comprises bearing housings, mounting axles, shafts, bearing joints and shields. Further uses of the lubricant grease compositions according to the present invention are e.g. agricultural machinery, bearings in damgates, low noise electric motors, large size electric motors, fans for cooling units, machine tool spindles, screw conveyor, and offshore and wind turbine applications.

A further subject matter of the present invention is a method for producing of the composition, preferably lubricant additive composition, as mentioned above and below comprising the steps of mixing a compound comprising a first metal element with a compound comprising a second metal element and forming particles, preferably nanoparticles, preferably comprising the second metal component.

The expressions "compound comprising a first metal element" and "compound comprising a second metal element" clarify that the educts for forming the composition, preferably lubricant additive composition, as mentioned above and below could be the same as being included in the composition, preferably lubricant additive composition. However, the educts used for producing the composition, preferably lubricant additive composition, could be different than the components as included in the composition, preferably lubricant additive composition. That is, e.g. the method for producing of the composition, preferably lubricant additive composition, may start with soluble components which are at least partly reacted to form the particles, preferably nanoparticles comprising the second metal component. Furthermore, the particles, preferably nanoparticles may include metallic compounds such as metallic copper or a copper tin alloy. However, these substances may be formed during a reaction of the educts.

Preferably, a composition comprising particles, preferably nanoparticles, are formed by reacting salts of at least two metal elements, e.g. soluble copper salt and tin salt. Preferably a copper (II) salt can be used together with a tin (II) and/or a tin (IV) salt as mentioned above and below.

Preferably, the reaction of a compound comprising a first metal element and a compound comprising a second metal element is performed. In order to improve the reaction, the forming of the particles, preferably nanoparticles and/or the efficiency of the inventive composition, preferably lubricant additive composition, a complex of the second metal element can be used. More preferably, a complex of the second metal element is formed. The formation of the complex of the second metal element can be preferably done before the compound comprising the first metal element is mixed with the compound comprising a second metal element. That is, a complex comprising the second metal element is used to form the particles, preferably nanoparticles. The ligands useful for preparing the complex comprising the second metal element are disclosed above and below, with succinimide compounds being especially preferred.

Preferably, a reducing agent and/or a reducing auxiliary is added to the mixture being prepared for obtaining the composition, preferably lubricant additive composition. Preferred reducing agents and/or reducing auxiliaries are disclosed above and below; with amine compounds, especially aromatic amine compounds being preferred.

According to a preferred embodiment of the present invention, the particles, preferably nanoparticles, are formed by adding a reduction agent to a composition comprising an oxidized form of the second metal component, and an oxidized form of the first metal component. Using such approach, unexpected results are achieved. We believe that particles, preferably nanoparticles are formed comprising the first metal component and the second metal component. Therefore, a further subject matter of the present invention is a composition being obtainable by adding a reduction agent to a composition comprising an oxidized form of the second metal component and an oxidized form of the first metal component. Preferably, the composition is obtained by reacting a copper (II) salt, such as copper oleate and/or copper choride ($CuCl_2$) with a tin (IV) salt, such as $SnCl_4$.

In addition thereto, the reaction is preferably performed in a solvent. The solvent can also have complexing and/or reducing efficiency. That is, a succinimide compound can be used as solvent. Preferably an alcohol can be used as a solvent; with Diethylenglycol and/or octanol being preferred.

In a very preferred embodiment of the present method, in a first step a composition comprising particles, preferably nanoparticles is formed by reacting salts of at least two metal elements, e.g. soluble copper salt and a tin salt, the obtained composition comprising particles, preferably nanoparticles is mixed with a compound comprising the first metal element. Preferably, the compound comprising the first metal element that is added to the composition obtained in the first step is soluble in oil. E.g. in the first step a tin compound can be reacted with a copper compound in order to obtain particles, preferably nanoparticles. Preferably, the particle containing composition can be mixed with an oil soluble metal compound, preferably metal carboxylate, and more preferably metal carboxylate having 15 to 18 carbon atoms, such as a metal oleate. The metal carboxylate is preferably a carboxylate of copper, tin, cobalt, zinc, bismuth, manganese and/or molybdenum, preferably copper and/or cobalt, more preferably copper. Preferably, the particle containing composition can be mixed with an oil soluble copper compound, preferably copper oleate. Preferably, the particle containing composition can be mixed with an oil soluble cobalt compound, preferably cobalt oleate.

Regarding the first step of the reaction, preferably the weight ratio of the compound comprising a first metal element and the compound comprising a second metal element is in the range of 100:1 to 1:100, more preferably 10:1 to 1:10 and especially preferably 1:1 to 1:5. More preferably the weight ratio of the compound comprising a first metal element and the compound comprising a second metal element is in the range of 1:1 to 1:100, especially preferably 1:2 to 1:50 and more preferably 1:4 to 1:20.

Regarding the second step of the reaction, preferably the weight ratio of the composition obtained in the first step and compound comprising the first metal element is in the range of 100:1 to 1:1000, more preferably 10:1 to 1:100 and especially preferably 1:1 to 1:20. More preferably the weight ratio of the composition obtained in the first step and compound comprising the first metal element is in the range of 1:1 to 1:1000, especially preferably 1:2 to 1:500 and more preferably 1:5 to 1:100.

Furthermore, the mixing of a compound comprising a first metal element with a compound comprising a second metal element in order to form particles can be performed in a wide temperature range. Preferably, the temperature of the step for forming particles can be achieved at temperatures in the range of −10° C. to 200° C., more preferably 5° C. to 100° C., especially preferably 20° C. to 80° C., and most preferably 40° C. to 60° C.

Preferably, in a second step, a soluble metal compound, e.g. a soluble metal compound being derived from the first metal element and/or a soluble metal compound being derived from a third metal element as mentioned above and below, can be mixed with the particle containing composition. The mixing can be achieved in a wide temperature range. Preferably, the temperature of the second step can be achieved at temperatures in the range of −10° C. to 200° C., more preferably 5° C. to 150° C., especially preferably 20° C. to 100° C., and most preferably 40° C. to 70° C.

Another subject of the present invention is a nanoparticle comprising composition being obtainable by reacting salts of at least two metal elements, e.g. soluble copper salt and a tin salt, the obtained composition comprising particles, preferably nanoparticles is mixed with a soluble compound comprising the first metal element and/or a third metal element, preferably an oleate of copper, cobalt, manganese, bismuth and/or zinc.

Further embodiments of the particle comprising composition being obtainable by reacting salts of at least two metal elements are disclosed with regard to the composition, preferably lubricant additive composition, including particles, preferably nanoparticles comprising the second metal component as mentioned above and below.

A further subject matter of the present invention is the use of a composition, preferably lubricant additive composition according to the present invention for reducing wear of lubricated surfaces.

As mentioned above and below in more detail, the composition according to the present invention improves the efficiency of conventional additives, especially, metal based friction and/or wear reducing additives. Furthermore, the present composition can be realized without the use of sulfur and/or phosphorus. Therefore, the present invention provides lubricant additive compositions, lubricant compositions, lubricant concentrate compositions and/or grease compositions comprising a base oil and at least one metal based friction and/or wear reducing additive, and optionally at least one viscosity improver, wherein the total wt. % of sulfur and/or phosphorous in the lubricant additive composition, the lubricant composition and/or the grease composition is derived from the one or more base oils. If the base oil used does contain no sulfur and/or phosphorous, a zero sulfur and/or zero phosphorous lubricant and/or grease could be achieved.

Furthermore, the present composition enables a replacement of conventional additives, especially, metal based friction and/or wear reducing additives.

As mentioned above and below, the present composition can be used as lubricant additive composition. Furthermore, the composition can be included in lubricants and greases. In addition thereto, the composition can be used for other purposes, e.g. the improvement of the efficiency of hydraulic oils and fluids being used for the processing metal surfaces.

The present invention provides a lubricant additive composition, a lubricant composition and a grease composition leading to a reduction in the fuel consumption and provides protection against wear. Preferably, the lubricant additive composition according to the present invention does not comprise essential amounts of phosphorus-nor sulfur-based compounds. Moreover, this lubricant additive composition and lubricant composition enables operational benefits, for example reduced oil consumption, longer oil drain intervals, fewer engine deposits, less equipment downtime, savings on maintenance costs, and lower exhaust emissions as evidenced by extensive field tests in marine engines. In addition, this lubricant additive composition and grease composition enables operational benefits, for example lower grease consumption, extended grease relubrication intervals, reduced equipment downtime, and increased equipment reliability and life as evidenced by extensive field tests in various industrial applications.

The following examples illustrate the invention further without any intention that this should impose a restriction.

EXPERIMENTAL METHODS

Fourier Transformed Infrared Resonance Spectroscopy

Fourier Transformed Infrared Resonance Spectroscopy (FTIR) spectra were recorded with a BrukerIFS66/S spectrometer equipped with a diamond crystal. The spectra were measured with a resolution of 4 cm-1 and the number of scans was 32.

Voltammetry

Cyclic voltammograms (CVs) were recorded in 10 μL and 20 μL of the samples mixed with 10 mL of 0.1 M tetrabutylammonium tetrafluoroborate ($TBABF_4$) in acetonitrile (ACN) solutions. The working electrode was a glassy carbon disk electrode, the reference electrode was an Ag/AgCl//3 M KCl electrode and the counter electrode was a glassy carbon rod. Before CV, the open-circuit potential was registered. Three CV cycles were then recorded in the potential range +1 V to −0.5 V with a scan rate of 50 mV/s.

Tribology Tests

An MCR 302 rotational rheometer from Anton Paar, with a measuring system BC 12.7, was used for the tribology measurements, by using a ball-on-three-plates system. Stribeck Curves were recorded for oil containing different additives and compared to that one for oil without additives.

The samples were measured by applying a speed ramp from 0.01 up to 3000 rpm while a normal load of 25 N was applied. The coefficient of Friction (COF) was recorded every 5 s as a function of the velocity. The temperature of the measuring cell was set to 60° C. The friction and wear tests of example No 5 was measured at Fraunhofer Institute, Mikrotribologie Centrum, Karlsruhe, Germany by using ball-on-three-plates system for friction tests and piston ring—liner simulator (PLS) for performing conventional wear analysis.

Chemicals Used $CuCl_2 \times 2\ H_2O$, diethylene glycol, diphenyl amine, $SnCl_4 \times 5\ H_2O$, $SnCl_2$, Sn-2-ethylhexanoate, octanol, xylene, oleic acid, tall oil acid and Cu-2-ethylhexanoate were supplied by Sigma-Aldrich. Copper-oleate (Cu-oleate) was supplied by CrisolteQ Ltd., Harjavalta, Finland. The succinimide additive C-5A was supplied by LLK-Naftan. The lubrication oils used are marine oils manufactured from Group I base oils if not otherwise indicated in the examples.

Example 1: Complex Activation by Coordination

Preferably, an activation of the nano-complex is achieved involving the coordination of a reducing metal. Suitable ligands or molecules for this are molecules containing for instance carbonyl, carboxyl, ester, amine, amide, imide, and/or hydroxyl functional groups. In order to verify the coordination in the systems according to the invention a system based on succinimide (C-5A) was selected as a model system due to the common use of this compound in lubrication additives. The reducing metal selected was tin in both the stannic and stannous forms.

A mixture of 94 g C-5A and 5.7 g $Sn(II)Cl_2$ was added to 50 ml xylene and boiled under reflux for 6 h after which the xylene was removed by distillation under reduced pressure with a rotavapor. Another sample was made by mixing 9.10 g stannous-2-ethylhexanoate, 20.84 g 1-octanol and 4.97 g C-5A together at room temperature and stored at ambient conditions over night. A third sample was made by mixing 8.95 g $SnCl_4 \times 5\ H_2O$ and 20.85 g octanol together with 29.8 g C-5A. FTIR-spectra were recorded for all three samples shown in FIG. 2.

FIG. 2 shows the change in the carbonyl peak for succinimide as a result of the complex formation by coordination. The coordination behaviour was verified by FTIR and found to take place regardless oxidation state and could be noticed for both inorganic salts ($SnCl_2$, $SnCl_4$) but also for one organometallic salt tested (Sn(II)-2-ethylhexanoate). The total disappearance of the peaks related to the carbonyls indicates that tin is possibly coordinated to succinimide-groups in a bidentate manner.

Example 2: Forming of a Lubricant Additive Composition

Preferably, the coordinated complex can be further activated in order to be able to initiate the redox reactions in the tribolayer. With the goal to verify the activation of the complex a further metallic compound was added together with an assisting reductant in order to ensure the initiation of the reactions. The model system was expanded with the inclusion of a reducible metal salt ($CuCl_2$) and an assisting reductant (diphenyl amine) and the reducibility was monitored by voltammetry scans. A sample of 0.76 g $CuCl_2 \times 2\ H_2O$ and 7.45 g diethylene glycol was added to a mixture of 4.5 g C-5A, 3.66 g diphenyl amine, 8.95 g $SnCl_4 \times 5\ H_2O$ and 20.85 g octanol (activated complex). A reference sample was prepared by mixing 0.76 g of $CuCl_2 \times 2\ H_2O$ and 7.45 g diethylene glycol.

It is demonstrated in the voltammograms in FIGS. 3 and 4 that the reduction peak for copper has been shifted to higher potentials after the addition of the activating substances. The shifted reduction peak for copper in the activated complex verifies that the reducibility of copper is increasing as a result of the activation.

Example 3. Tribological Effects of the Lubricant Additive Composition

An activated complex was added to a reducible adduct in order to initiate the tribochemical reactions of the synthetic molecular machine to be demonstrated in tribology tests in a ball-on-three-plates system. A composition of the present invention was prepared by stepwise adding the activated complex used in Example 2 to molten copper-oleate (as an organometallic compound) to different ratios in weight as mentioned in Table 5 under rigorous mixing at 60-70° C. The composition of the present invention was added to Teboil Marine Oil Ward 30 EA (3 wt. % composition of the present invention) and heated to 60-70° C. under mixing for ca 5 min. The homogenous oil mixture was allowed to cool down at ambient conditions. Similar oil-additive mixtures of oil and copper-oleate, and oil and the activated complex of Example 2 were prepared by using the same procedure. The samples were tested by tribology measurements by using an Anton Paar rotational rheometer (Table 5).

TABLE 5

Coefficient of friction at different ratios of the metal components being contained in the additive composition at different velocities

| Sample No | Additive description | Weight ratio | COF at 0.0001 m/s | COF at 0.001 m/s | COF at 0.01 m/s |
|---|---|---|---|---|---|
| 1 | No additive | n/a | 0.1310 | 0.1340 | 0.1330 |
| 2 | Cu-oleate/ activated complex | 100/0 | 0.0914 | 0.1030 | 0.1180 |
| 3 | Cu-oleate/ activated complex | 99/1 | 0.0753 | 0.0802 | 0.0854 |
| 4 | Cu-oleate/ activated complex | 95/5 | 0.0725 | 0.0776 | 0.0936 |
| 5 | Cu-oleate/ activated complex | 90/10 | 0.0814 | 0.0823 | 0.0890 |
| 6 | Cu-oleate/ activated complex | 80/20 | 0.0810 | 0.0841 | 0.0864 |

From the tribology measurements it became apparent that the composition of the present invention has an advantageous impact on the friction behaviour. The inventors believe that the effects are due to the dynamic and reversible redox reactions.

Example 4: Effect of Concentration of the Lubricant Additive Composition in Oil Further experiments were done in order to elucidate the effect of the amount of activated complex needed for a satisfactory lubricating effect of the additive. The composition comprising an activated complex and Cu-oleate prepared in Example 3 was added to Teboil Marine Oil in two different concentrations (0.3 and 3 wt. %). The samples were tested by wear analysis at Fraunhofer Institute, Freiburg, Germany (Table 6)

TABLE 6

Effect of additive concentration in oil on coefficient of friction and wear

| Concentration of composition comprising an activated complex and Cu-oleate | Wear/nmh$^{-1}$ |
|---|---|
| 0 wt. % | 2.80 |
| 0.3 wt. % | 1.07 |
| 3.0 wt. % | 1.10 |

Example 5: Beneficial Impacts of the Additive in Lubricating Systems in Field Tests The effects of the additive have been monitored in several field tests. In one test the product of the Cu-oleate based additive, as described in Example 3, was added to a group I base oil in a 10% ratio for producing a concentrate. This concentrate was thereafter added to a fully formulated marine engine oil (Shell Argina X40), ending up with a final concentration of 0.3 wt. % of the Cu-oleate based SMMA in the ready-made lubrication oil. This lubrication oil was added to a Wärtsilä 8L20 marine auxiliary engine, which typically runs at 1000 rpm speeds, with a piston speed of 9.3 m/s and piston stroke of 280 mm. The performance of the engine was monitored by measuring the specific fuel oil consumption (SFOC), in g/kWh as a function of load, in % and output (kW). In another field test gear oil (Castrol Alphasyn PG) was used in a ca 100 hour planetary gear box application test after which 0.3 wt. % of the Cu-oleate based additive as described in Example 3 was added to the oil and the engine was allowed to run for ca 100 additional hours. Lubrication oil samples were withdrawn after 1 hour and after 100 hours, from both 100 hour sequences. The amount of iron in the lubrication oil was determined according to ASTM D5185. The positive lubricating effects of the SMMA in the examples are noticeable for both oils in terms of less formation of dissolved metal particles and a significant decrease in fuel consumption (Table 7).

TABLE 7

Effect of activated complex in different lubrication systems compared to no additive.

| Test | Lubricating system specification | Without additive | 3 wt. % additive addition |
|---|---|---|---|
| Iron content after ca 1 h of test (ASTM D5185) | Castrol Alphasyn PG | 6 ppm | 1 ppm |
| Iron content after ca 100 h of test (ASTM D5185) | Castrol Alphasyn PG | 41 ppm | 17 ppm |
| Fuel consumption at a load of ca 540 kW (40% of max) | Shell Argina X40 | 262 g/kWh | 227 g/kWh |

Example 6: Additional Examples of the Synthetic Molecular Machine Technology Based on a Range of Different Metals Further experiments were conducted in order to demonstrate the broad application of the synthetic molecular machine technology using of different metals. Friction and wear tests were also carried out using the Anton-Paar machine to determine the performance of these different systems.

The measurement starts with a running-in phase to ensure flattening of the sample and constant measuring conditions. This is done at 1200 rpm for 30 minutes. After running-in, the friction behavior is measured in the "Stribeck phase" during the next 10 minutes. The measuring regime starts at 0 rpm and the speed increases during the 10 minutes to 3000 rpm. The normal force is 6N and the temperature 100° C. throughout the measurement.

Wear is measured by analyzing the wear scars on the plates with optical microscope and imaging software after friction analysis In Examples 6 and 7, the following parameters for friction and wear tests are used:

| | |
|---|---|
| Normal force $F_N$ | 6 N |
| Running in phase | 1200 rpm, 30 min |
| Stribeck phase | 0-3000 rpm, 10 min |
| Temperature | 100° C. |

Figure 7:
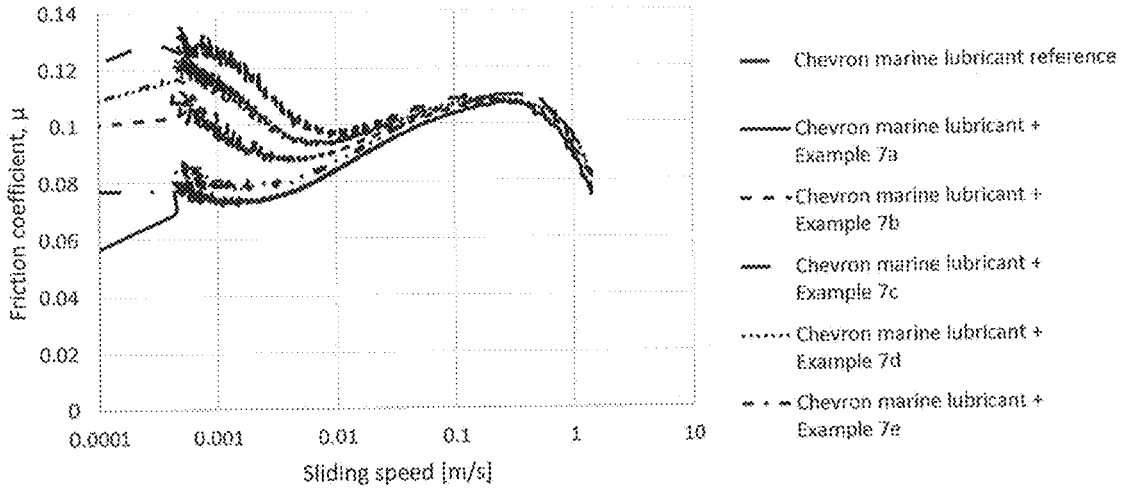
FIG. 7 shows results of the tests according to Examples 6 and 7.

The results of this testing are given in Table 8 and FIG. 7.

Example 6a: Synthetic Molecular Machine System Based on Copper

The first stage is preparation of copper oleate.

Copper oleate was made by reacting copper carbonate with an excess of oleic acid. The reaction was conducted by placing oleic acid (about 825 grams) into a reaction vessel equipped with a thermometer, condenser, distilling trap, and stirrer. Copper carbonate (about 150 grams) was slowly added to the reaction vessel with vigorous stirring. The reactants were heated to about 150° C. and stirred for 16 hours. A sub-atmospheric pressure was also applied to the reaction vessel. Condensate from the reaction was collected in the trap. At the end of the reaction the copper oleate mixture was filtered and allowed to cool to 60° C.

The second stage is preparation of the activated complex that involves a three-step process.

The first step is preparation of the copper (II) chloride solution. Diethylene glycol (about 3.5 kg) was placed in a glass-lined vessel fitted with a stirrer and heating capability. This was heated to about 40° C. and copper chloride (0.357 kg) was slowly added with stirring to ensure the material is totally dissolved. The C-5A succinimide (2.1 kg) was then slowly added with stirring but no heating. Diphenylamine (1.72 kg) was next added in small portions and the mixture was stirred to ensure it was homogenous. Finally DEG-1 epoxy resin (1.86 kg) was added and thoroughly stirred.

The second step is preparation of the tin (IV) chloride solution. In a separate glass-lined vessel fitted with a stirrer and heating capability, Tin (IV) chloride pentahydrate (4.2 kg) was dissolved in octanol (about 9.8 kg) by stirring the mixture at about 40° C.

The third step is making of the activated complex. In a separate glass-lined vessel fitted with a stirrer and cooling capability, the tin (IV) chloride solution prepared above was added to the copper (II) chloride solution also prepared above under stirring. The tin (IV) chloride solution was be added in small portions and the temperature must be maintained below 50° C. After the addition was complete the mixture was stirred for a further period to ensure it was homogenous.

The final stage is preparation of the synthetic molecular machine system based on copper. This is carried out by slowly adding the activated complex (23.5 kg) to the copper oleate (about 970 kg) in a glass-lined vessel fitted with a stirrer and heating capability. The temperature of the mixture was maintained at about 60° C. and stirred for a further period to ensure it was homogenous.

Figure 6:
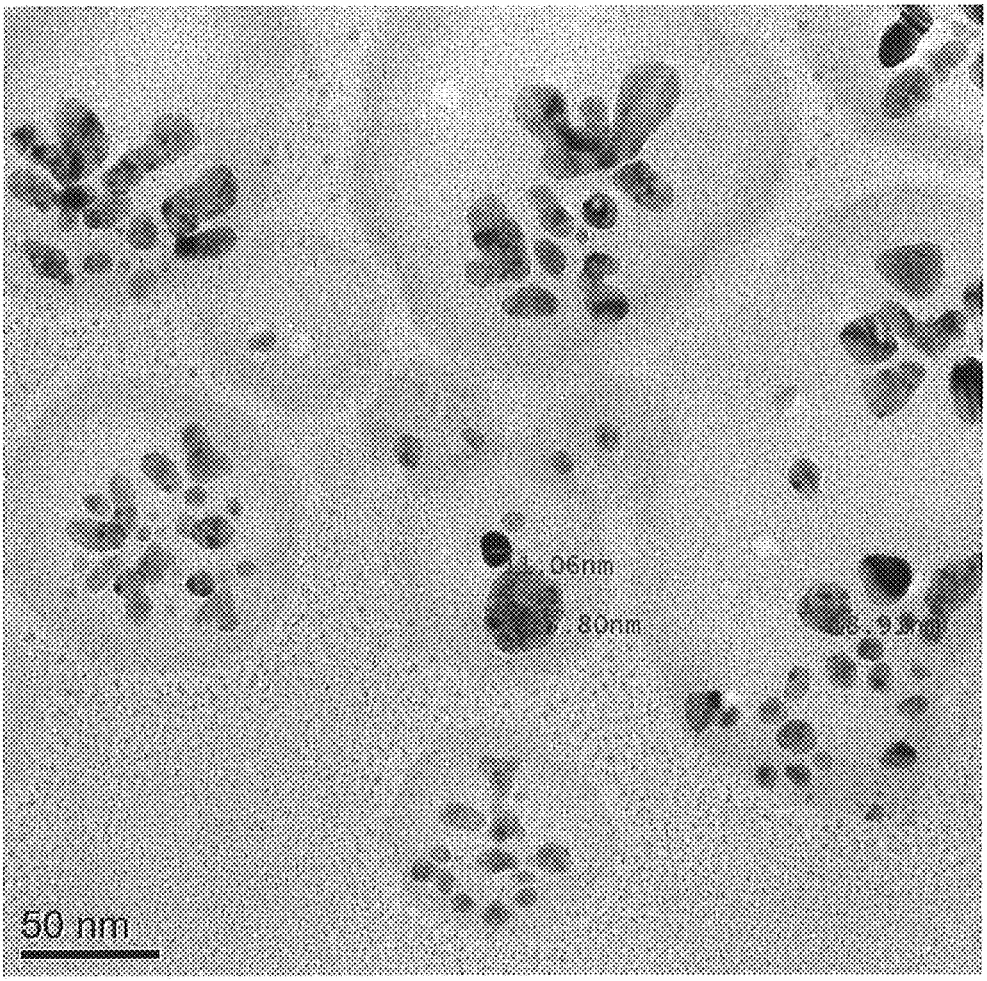

Transmission electron microscopy pictures of the additive have been made. Two pictures are shown in FIGS. 5 and 6.

Example 6b: Synthetic Molecular Machine System Based on Bismuth

The first stage is preparation of bismuth oleate.

Bismuth oleate was made by reacting bismuth carbonate with an excess of oleic acid. The reaction was conducted by placing oleic acid (about 91 grams) into a reaction vessel equipped with a thermometer, condenser, distilling trap, and stirrer. Bismuth carbonate (about 11 grams) was slowly added to the reaction vessel with vigorous stirring. The reactants were heated to about 150° C. and stirred for 16 hours. A sub-atmospheric pressure was also applied to the reaction vessel. Condensate from the reaction was collected in the trap. At the end of the reaction the bismuth oleate mixture was filtered and allowed to cool to 60° C.

The second stage is preparation of the activated complex that involves a three-step process. This was carried out as described above in Example 7a.

The final stage is preparation of the synthetic molecular machine system based on bismuth. This is carried out by adding the activated complex (2.4 grams) made above to the bismuth oleate (about 100 grams) in a glass-lined vessel fitted with a stirrer and heating capability. The temperature of the mixture was maintained at about 60° C. and stirred for a further period to ensure it was homogenous.

Example 6c: Synthetic Molecular Machine System Based on Cobalt

The first stage is preparation of cobalt oleate.

Cobalt oleate was made by reacting cobalt carbonate with an excess of oleic acid. The reaction was conducted by placing oleic acid (about 91 grams) into a reaction vessel equipped with a thermometer, condenser, distilling trap, and stirrer. Cobalt carbonate heaxahydrate (about 35 grams) was slowly added to the reaction vessel with vigorous stirring. The reactants were heated to about 150° C. and stirred for 16 hours. A sub-atmospheric pressure was also applied to the reaction vessel. Condensate from the reaction was collected in the trap. At the end of the reaction the cobalt oleate mixture was filtered and allowed to cool to 60° C.

The second stage is preparation of the activated complex that involves a three-step process. This was carried out as described above in Example 7a.

The final stage is preparation of the synthetic molecular machine system based on cobalt. This is carried out by adding the activated complex (3 grams) made above to the cobalt oleate (125 grams) in a glass-lined vessel fitted with a stirrer and heating capability. The temperature of the mixture was maintained at about 60° C. and stirred for a further period to ensure it was homogenous.

Example 6d: Synthetic Molecular Machine System Based on Manganese

The first stage is preparation of maganese oleate.

Manganese oleate was made by reacting manganese carbonate with an excess of oleic acid. The reaction was conducted by placing oleic acid (about 91 grams) into a reaction vessel equipped with a thermometer, condenser, distilling trap, and stirrer. Manganese carbonate (about 19 grams) was slowly added to the reaction vessel with vigorous stirring. The reactants were heated to about 150° C. and stirred for 16 hours. A sub-atmospheric pressure was also applied to the reaction vessel. Condensate from the reaction was collected in the trap. At the end of the reaction the manganese oleate mixture was filtered and allowed to cool to 60° C.

The second stage is preparation of the activated complex that involves a three-step process. This was carried out as described above in Example 7a.

The final stage is preparation of the synthetic molecular machine system based on manganese. This is carried out by adding the activated complex (2.6 grams) made above to the manganese oleate (about 110 grams) in a glass-lined vessel fitted with a stirrer and heating capability. The temperature of the mixture was maintained at about 60° C. and stirred for a further period to ensure it was homogenous.

Example 6e: Synthetic Molecular Machine System Based on Zinc

The first stage is preparation of zinc oleate.

Zinc oleate was made by reacting zinc carbonate with an excess of oleic acid. The reaction was conducted by placing oleic acid (about 91 grams) into a reaction vessel equipped with a thermometer, condenser, distilling trap, and stirrer. Bismuth carbonate (about 15 grams) was slowly added to the reaction vessel with vigorous stirring. The reactants were heated to about 150° C. and stirred for 16 hours. A sub-atmospheric pressure was also applied to the reaction vessel. Condensate from the reaction was collected in the trap. At the end of the reaction the zinc oleate mixture was allowed to cool to 60° C.

The second stage is preparation of the activated complex that involves a three-step process. This was carried out as described above in Example 7a.

The final stage is preparation of the synthetic molecular machine system based on zinc. This is carried out by adding the activated complex (2.5 grams) made above to the zinc oleate (about 105 grams) in a glass-lined vessel fitted with a stirrer and heating capability. The temperature of the mixture was maintained at about 60° C. and stirred for a further period to ensure it was homogenous.

Friction and wear tests were also carried out using the Anton-Paar machine to determine the performance of these different systems. The results of this testing are given in Tables 8 and 9 and FIG. 7.

TABLE 8

Wear results of the synthetic molecular machine technology based on different metals.

| Sample | Wear reduction (−) or wear increase (+) |
|---|---|
| Chevron Taro Marine Oil + 0.3% Example 7a (Copper) | −48% |

TABLE 8-continued

Wear results of the synthetic molecular machine technology based on different metals.

| Sample | Wear reduction (−) or wear increase (+) |
|---|---|
| Chevron Taro Marine Oil + 0.3% Example 7b (Bismuth) | −17% |
| Chevron Taro Marine Oil + 0.3% Example 7c (Cobalt) | −45% |
| Chevron Taro Marine Oil + 0.3% Example 7d (Manganese) | −11% |
| Chevron Taro Marine Oil + 0.3% Example 7e (Zinc) | −16% |

TABLE 9

Coefficient of friction based on different metals

| Additive description | COF at 0.0001 m/s | COF at 0.001 m/s | COF at 0.01 m/s |
|---|---|---|---|
| Chevron Taro Marine Oil (Reference) | 0.1256 | 0.0966 | 0.1094 |
| Chevron Taro Marine Oil + 0.3% Example 7a (Copper) | 0.0736 | 0.0833 | 0.1043 |
| Chevron Taro Marine Oil + 0.3% Example 7b (Bismuth) | 0.0985 | 0.0904 | 0.1066 |
| Chevron Taro Marine Oil + 0.3% Example 7c (Cobalt) | 0.0788 | 0.0864 | 0.1053 |
| Chevron Taro Marine Oil + 0.3% Example 7d (Manganese) | 0.1166 | 0.0949 | 0.1073 |
| Chevron Taro Marine Oil + 0.3% Example 7e (Zinc) | 0.1163 | 0.0937 | 0.1066 |

Example 7: Example Comparing the Synthetic Molecular Machine Technology with the Metal Plating Concentrate Cited in the Russian Patent RU 2,124,556

Further experiments were conducted in order to compare the synthetic molecular machine technology to the metal-plating additive prior art disclosed in Russian patent RU 2,124,556 to demonstrate the advantages of the current invention.

Example 7a: The Synthetic Molecular Machine System Based on Copper

A composition of the present invention was prepared as described in example 6a above.

Example 7b: The Metal Plating Additive Concentrate Cited in the Russian Patent RU 2,124,556

This Russian patented invention discloses metal-plating compositions that are claimed to be useful as additives for reducing wear of metal friction surfaces. The specific example prepared was composition number 3 according to the information disclosed in the Russian patent RU 2,124,556. The mixture comprised of 80 parts copper-tin powder, containing up to 20% tin and purchased from Sigma-Aldrich; 3.4 parts of stearic acid; 1.6 parts of copper stearate thoroughly mixed into 14 parts petroleum solvent (white spirit) plus 1 part mineral oil (150SN group I base oil). The end product was vigorously mixed but it was not clear and bright. It was found to be a suspension that was not homogeneous. Particles quickly separated agglomerated and formed sediment after short-term storage under ambient conditions. The sample was thoroughly shaken and stirred again before testing to ensure it was as representative as possible of the Russian invention.

Figure 8:
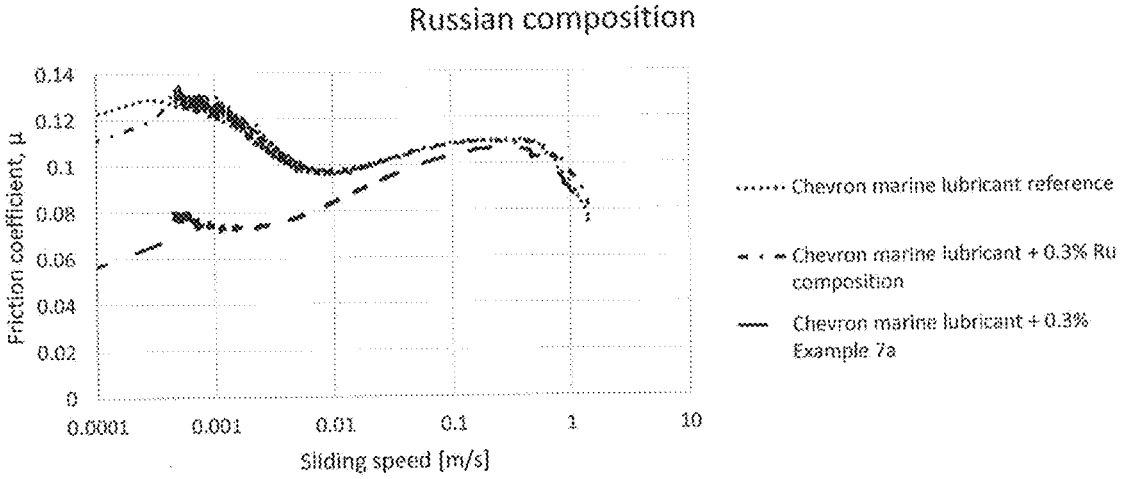
FIG. 8 shows results of the tests according to Examples 7a and 7b.

Friction and wear tests were carried out on the material from examples 7a and 7b using the Anton-Paar machine to determine the comparative performance of the two technologies. The results of this testing are given in Tables 10 and 11 and FIG. 8.

TABLE 10

Wear results comparing the synthetic molecular machine technology with the metal plating concentrate according to prior art.

| Sample | Wear reduction (−) or wear increase (+) |
|---|---|
| Chevron Taro + 0.3% Example 7a (Synthetic Molecular Machine Technology) | −48% |
| Chevron Taro + 0.3% Example 7b (Metal Plating Concentrate) | +14% |
| Chevron Taro + 2.5% Example 7b (Metal Plating Concentrate) | −6% |

TABLE 11

Coefficient of friction comparison with metal plating concentrate according to prior art

| Additive description | COF at 0.0001 m/s | COF at 0.001 m/s | COF at 0.01 m/s |
|---|---|---|---|
| Chevron Taro Marine Oil (Reference) | 0.1256 | 0.0966 | 0.1094 |
| Chevron Taro Marine Oil + 0.3% Example 7a | 0.0736 | 0.0833 | 0.1043 |
| Chevron Taro + 0.3% Reference Example 7b | 0.1225 | 0.0967 | 0.1090 |
| Chevron Taro + 2.5% Reference Example 7b | 0.1185 | 0.0984 | 0.1095 |

Furthermore, a stability test were performed in order to approve the stability of the composition of the invention (Example 7a), especially in comparison with the prior art composition according to Reference Example 7b. The stability test includes a centrifugation of the samples at 500 and 2500 rpm using a conventional centrifuge. In a first step, the examples were centrifuged for 15 min at 500 rpm and thereafter again for 15 min at 2500 rpm in a 50 ml centrifuge tube. After each step a visual evaluation has been performed. The Example 7a shows no change of the composition. At the beginning and at the end, the dispersion showed no precipitation of particles at the tip of the centrifuge tube. In contrast thereto, the Reference Example 7b showed a precipitation of the particles, such that a cloudy supernatant was obtained after 15 min at 500 rpm and a clear supernatant was obtained after 15 min at 2500 rpm. The particles were concentrated at the tip of the centrifuge tube.

Example 8

Continuous wear measurements were carried out using the radionuclide technique (RNT). The advantages of RNT technique are its accuracy as well as its ability to measure wear rates under transient conditions, not only just at the end of test.

The RNT technique was applied to a pin-on-disk tribometer in order to measure friction and wear. This was combined with focused ion beam analysis used to obtain microscopic cross sections of the materials and to investigate near-surface material. Chemical analysis was also carried out using the XPS technique to quantify mechanical intermixing in the near metal surface.

Gray cast iron was used as disk material in the pin-on-disk tribometer. A chromium-plated steel pin material was also used with a diameter of 5 mm. For all tests, a sliding velocity of 2 m/s was applied. The contact pressure ranged from 25-45 MPa. Two types oil were used for the tests. All reference tests were performed with Castrol Edge 5W30. The marine lubricant oil contained 3% of a lubricant additive of the present invention (see Example 7a and 8a); copper based synthetic molecular machine complex.

The friction and wear signals were monitored throughout the duration of the pin-on-disk RNT tests. The first oil tested was the Castrol Edge reference oil. An initial drop in the friction coefficient from 0.15 to 0.11 was observed. This was caused by an instant decrease in roughness due to the first contact of pin and disk (running-in). After the initial drop in friction there was a slight increase in friction. This can be attributed to the formation of a glassy film on the metal surface containing zinc, phosphorous, calcium and sulfur. This is formed from the interaction of zinc dialkyldithiophosphate and overbased calcium sulfonate that are additives commonly used in engine oil formulations. During the course of the experiment this film became intermixed with the near-surface material and formed the so-called third body that is important in friction reduction and wear protection of metal surfaces. The friction coefficient stabilized at 0.015. In the initial phase of the test the rate of wear drastically increased. After the running-in stage was completed the wear rate decreased and stabilized.

The reference oil was then replaced by marine oil containing 3% of a copper based lubricant additive utilizing the present invention. Almost instantly friction dropped to values below the resolution limit of the measuring equipment and remained extremely low until the end of the experiment. The total rate of wear decreased by over 20% with the copper based lubricant additive and remained constant throughout the remainder of the test.

The metal surface of the disk was analyzed after the test, up to a depth of 180 nm. Close to the surface the iron was oxidized. A thin hydrocarbon film covered the metal surface. Calcium was found to be the most dominant inorganic element present with a concentration of about 8% at 180 nm depth. Low concentrations of phosphorous, zinc and sulfur were also found. Copper was detected near the surface up to a depth of about 10 nm. The copper concentration was very low. It was concluded that this low level of copper was either due to a very thin layer or an intermittent distribution across the surface.

The XPS technique was used to analyze the depth profile inside the wear track of the disk. This confirmed that copper was present on metal surface and in the near surface of the both friction bodies. While only very low concentrations of copper were found on the metal surface, the intermixing of copper into the near surface was significant. But importantly no calcium, zinc, phosphorous or sulfur was detected.

This research provided important and significant insights about the effectiveness and functional mechanism of the present invention. The instant drop of friction when the copper based lubricant additive was added showed that no incubation time was necessary to induce this effect. An immediate reduction in the rate of wear was also observed at the same time. It was concluded that a layer of additional material (a copper tribofilm) was formed on the metal surfaces to separate the friction bodies and produce these rapid effects. These positive effects of low friction and reduced wear remained stable. This indicates that the tribofilm must be stable and also able to withstand the mechanical attacks of the asperities. The XPS depth analyses showed that the copper based additive from the current invention is able to work concurrently with the other conventional additives in the lubricant and does not interfere in a negative manner with the action of other additives such as ZDDP. Copper was found up to a depth of about 10 nm that is too deep to be caused by simple intermixing. It indicates that the copper initially forms a film on the metal surface but it is also able to rapidly integrate into the near surface and modify the metal structure to improve wear protection.

The overall findings obtained in this research investigation are depicted in a schematic; see Figure below. The spherical micelles are non-polar and are dispersed in the lubricant base oil. These micelles are disrupted by frictional metal-metal contact of asperities on the metal surfaces under the high contact pressures. This releases the copper particles, preferably nanoparticles from the micelles and they are deposited and adsorbed onto the metal surfaces to form a tribofilm. The outer surface of the copper tribofilm may become oxidized to enhance its low friction performance characteristics. The copper can also integrate into the near-surface volume where it can accumulate. This can modify the tribo-chemical of the near surface material and structure. Further mechanical intermixing leads to a deeper intake of copper in the near surface. As the copper is removed from tribofilm on the metal surface due to lateral frictional forces, new layers of copper film are formed on the metal surface to give sustained and robust performance in terms of friction reduction and wear protection. This is part of the self-healing process.

Example 9—Lubricant Formulations with the Additive of the Present Invention Replacing Other Conventional Additives

Example 9a—API CG-4/SJ, SAE15W40, Heavy-Duty Diesel Engine Oil Formulation, Zero Phosphorous

| | |
|---|---|
| Group I base oils | 96.047% wt |
| Viscosity modifier | 1% wt |
| Pour point depressant | 0.3% wt |
| Antifoam | 0.003% wt |
| Copper based additive complex | 0.3% wt |
| Antioxidant | 1% wt |
| Detergent | 1.5% wt |

The inventors found that the lubrication composition and heavy-duty diesel engine motor oil as mentioned above showed increased fuel economy, reduced emissions and good performance in terms of reduced engine cleanliness, lower oil consumption, effective control of engine wear, and good oxidation and thermal stability.

Example 9b—API CI-4/SL, SAE10W40, Heavy-Duty Diesel Engine Oil Formulation, Zero Phosphorous

| | |
|---|---|
| Group III base oils | 92.197% wt |
| Viscosity modifier | 0.9% wt |
| Pour point depressant | 0.3% wt |

-continued

| | |
|---|---|
| Antifoam | 0.003% wt |
| Copper based additive complex | 0.3% wt |
| Antioxidants | 1.0% wt |
| Dispersant | 2.5% wt |
| Detergent | 2.5% wt |

The inventors found that the lubrication composition and heavy-duty diesel engine motor oil as mentioned above showed increased fuel economy, reduced emissions and good performance in terms of improved engine cleanliness, lower oil consumption, good engine wear protection in the valve train, piston ring and cylinder liner areas, and good oxidation and thermal stability.

Example 9c—Semi-Synthetic, SAE 5W-40, API SL/CF, Passenger Car Motor Oil, Zero Phosphorous

| | |
|---|---|
| Group I SN150 base oil | 64.597% wt |
| Group III 4 centistoke base oil | 30% wt |
| Viscosity modifier | 1.1% wt |
| Pour point depressant | 0.3% wt |
| Antifoam | 0.003% wt |
| Copper based additive complex | 0.3% wt |
| Antioxidants | 1% wt |
| Dispersant | 1.7% wt |
| Detergent | 1% wt |

The inventors found that the lubrication composition and passenger car motor oil as mentioned above showed increased fuel economy, reduced emissions and high performance in terms of improved engine cleanliness, lower oil consumption, effective control of wear, and good oxidation and thermal stability.

Example 9d—Synthetic, SAE 5W-40, API SN/CF, Passenger Car Motor Oil, Zero Phosphorous

| | |
|---|---|
| Group III base oils | 93.297% wt |
| Viscosity modifier | 1.1% wt |
| Pour point depressant | 0.3% wt |
| Antifoam | 0.003% wt |
| Copper based additive complex | 0.3% wt |
| Antioxidants | 1.5% wt |
| Dispersant | 2.5% wt |
| Detergent | 1% wt |

The inventors found that the lubrication composition and passenger car motor oil as mentioned above showed increased fuel economy, reduced emissions and high performance in terms of reduced engine sludge and deposits, lower oil consumption, effective control of wear, and good oxidation and thermal stability.

Example 9e—VDL Compressor Oil, Zero Phosphorous, Low Sulfur

| | |
|---|---|
| Antioxidant - alkylated diphenylamine | 0.25% wt |
| Antioxidant - hindered phenolic | 0.25% wt |
| Antioxidant - phenyl-alpha-naphthylamine | 0.25% wt |

-continued

| | |
|---|---|
| Copper based additive complex | 0.15% wt |
| Base Oils + Antifoam + Demulsifier | 91.1% wt |

The inventors found that the lubrication composition and compressor oil as mentioned above showed good thermal and oxidation stability, improved equipment efficiency, low ash and deposit forming tendency, reduced sludge formation, and effective control of wear and rust.

Example 9f—HPL Hydraulic Oil, Zero Phosphorous, Low Sulfur

| | |
|---|---|
| Antioxidant - alkylated diphenylamine | 0.30% wt |
| Antioxidant- hindered phenolic | 0.25% wt |
| Demulsifier | 0.05% wt |
| Antifoam | 0.05% wt |
| Copper based additive complex | 0.15% wt |
| Base Oils | 91.2% wt |

The inventors found that the lubrication composition and hydraulic fluid as mentioned above showed improved pump efficiency, reduced wear of mechanical components, good filterability performance, effective control of system deposits, and robust thermal, oxidation, and hydrolytic stability as well as improved environmental compatibility.

The positive lubricating effects of the inventive additive in the examples above are demonstrated for motor- and gear oils, but similar positive effects can also be demonstrated for synthetic oils, bio-based oils and grease lubricants.

The invention claimed is:

1. A lubricant additive composition comprising nanoparticles including:

(a) a first metal component comprising metallic copper, and (b) a second metal component comprising a tin salt;

wherein the nanoparticles include a mixture of said metallic copper, said tin salt, and an oil-soluble metal compound derived from at least one of copper, tin, and a third metal component.

2. The lubricant additive composition according to claim 1, wherein the nanoparticles comprising the second metal component have a diameter in a range of 1 nm to 10000 nm.

3. The lubricant additive composition according to claim 1, comprising at least one reducing agent.

4. The lubricant additive composition according to claim 1, including the third metal component wherein the third metal component comprises at least one metal selected from the group consisting of cobalt, zinc, bismuth, and manganese.

5. The lubricant additive composition according to claim 1, wherein a weight ratio of the oil-soluble metal compound to the nanoparticles is in a range of 10000:1 to 1:1.

6. A lubricant composition comprising a lubricant additive composition according to claim 1 and an oil solvent or oil dispersing medium.

7. A grease composition comprising a lubricant additive composition according to claim 1 and an oil solvent or oil dispersing medium.

8. A method for producing the lubricant additive composition of claim 1, comprising forming said nanoparticles by mixing a solution including a copper compound with a solution including the second metal component, wherein at least one said solution comprises a reductant and the solution including the second metal component comprises a ligand capable of forming a complex with the tin in the second metal component.

9. The method according to claim 8, wherein a weight ratio of said copper compound to the tin salt is in a range of 100:1 to 1:100.

10. The lubricant additive composition according to claim 1, wherein the nanoparticles comprising the second metal component have a diameter in a range of 5 nm to 1000 nm.

11. The lubricant additive composition according to claim 1, wherein the nanoparticles comprising the second metal component have a diameter in a range of 10 nm to 500 nm.

12. The lubricant additive composition according to claim 1, wherein the nanoparticles comprising the second metal component have a diameter in a range of 15 nm to 400 nm.

13. The lubricant additive composition according to claim 1, wherein the lubricant additive composition comprises an oil-soluble metal compound derived from copper or cobalt.

14. The lubricant additive composition according to claim 1, wherein the lubricant additive composition comprises an oil-soluble metal compound derived from copper.

15. The lubricant additive composition according to claim 5, wherein a weight ratio of the oil-soluble metal compound to the nanoparticles is in a range of 1000:1 to 2:1.

16. The lubricant additive composition according to claim 5, wherein a weight ratio of the oil-soluble metal compound to the nanoparticles is in a range of 500:1 to 5:1.

17. The lubricant additive composition according to claim 5, wherein a weight ratio of the oil-soluble metal compound to the nanoparticles is in a range of 100:1 to 10:1.

18. The method according to claim 8, wherein a weight ratio of said copper compound to said tin salt is in a range of 10:1 to 1:10.

19. The method according to claim 8, wherein a weight ratio of said copper compound to said tin salt is in a range of 1:1 to 1:5.

* * * * *